US012643705B2

(12) United States Patent
Yourist

(10) Patent No.: US 12,643,705 B2
(45) Date of Patent: Jun. 2, 2026

(54) COLLAPSIBLE AND REBOUNDABLE BLOW-MOLDED BOTTLE

(71) Applicant: Graham Packaging Company, L.P., Lancaster, PA (US)

(72) Inventor: Sheldon E. Yourist, York, PA (US)

(73) Assignee: Graham Packaging Company, L.P., Lancaster, PA (US)

( * ) Notice: Subject to any disclaimer, the term of this patent is extended or adjusted under 35 U.S.C. 154(b) by 460 days.

(21) Appl. No.: 18/119,244

(22) Filed: Mar. 8, 2023

(65) Prior Publication Data

US 2024/0300688 A1 Sep. 12, 2024

(51) Int. Cl.

| | |
|---|---|
| ***B65D 1/32*** | (2006.01) |
| ***B65D 1/02*** | (2006.01) |
| ***B65D 47/06*** | (2006.01) |

(52) U.S. Cl.

CPC ..... *B65D 1/32* (2013.01); *B65D 1/0276* (2013.01); *B65D 1/0292* (2013.01); *B65D 47/06* (2013.01); *B65D 2501/0063* (2013.01); *B65D 2501/0081* (2013.01); *B65D 2547/066* (2013.01)

(58) Field of Classification Search

CPC ..... B65D 1/32; B65D 1/0276; B65D 1/0292; B65D 47/06; B65D 2501/0063; B65D 2501/0081; B65D 2547/066

USPC ..... 215/373

See application file for complete search history.

(56) References Cited

U.S. PATENT DOCUMENTS

| | | | | |
|---|---|---|---|---|
| 4,320,789 | A | 3/1982 | Martin et al. | |
| 4,984,712 | A | 1/1991 | Jouillat | |
| 7,568,588 | B2 * | 8/2009 | Yourist | B65D 1/0223 215/381 |
| 8,215,509 | B2 | 7/2012 | Kuboi et al. | |
| 9,387,684 | B2 | 7/2016 | Ogawa et al. | |
| 2002/0008077 | A1 * | 1/2002 | Lane | B65D 1/0223 215/381 |
| 2005/0031398 | A1 * | 2/2005 | Fischer | B43K 23/008 401/6 |

(Continued)

FOREIGN PATENT DOCUMENTS

| | | |
|---|---|---|
| GB | 384214 | 12/1932 |
| GB | 2354504 | 3/2001 |
| WO | 2012171753 A1 | 12/2012 |

OTHER PUBLICATIONS

International Search Report and Written Opinion for counterpart international patent application No. PCT/US2024/018779 mailed Jun. 5, 2024 by the European Patent Office ("EPO") acting in its capacity as International Searching Authority.

*Primary Examiner* — Don M Anderson
*Assistant Examiner* — Elizabeth J Volz
(74) *Attorney, Agent, or Firm* — Armstrong Teasdale LLP

(57) ABSTRACT

A blow-molded bottle including a top portion, a bottom portion and a collapsible portion. The collapsible portion further includes opposing panels and opposing sidewalls, the opposing panels having a contoured shape defined by a compound curvature. The compound curvature is defined by a convex longitudinally extending curvature and a concave laterally extending curvature extending between the opposing sidewalls. Application of a force to the opposing panels causes the opposing panels to collapse from an uncollapsed state to a collapsed state, and non-application of the force to the opposing panels returns the opposing panels to the uncollapsed state.

36 Claims, 24 Drawing Sheets

(56) References Cited

U.S. PATENT DOCUMENTS

| | | | | |
|---|---|---|---|---|
| 2006/0131258 | A1* | 6/2006 | Yourist | B65D 1/0223<br>215/381 |
| 2015/0238988 | A1 | 8/2015 | Nielsen | |
| 2018/0251254 | A1* | 9/2018 | Groot | B65D 23/003 |

* cited by examiner

COLLAPSIBLE AND REBOUNDABLE BLOW-MOLDED BOTTLE

BACKGROUND

The field of the disclosure relates generally to blow-molded bottles, and more particularly, to collapsible and reboundable blow-molded bottles Squeezable pouches are frequently used to store and dispense food or liquid from the pouch. For example, such food may include pureed food for an infant that is easily dispensed from the pouch. Known pouches may be squeezed by a child or other consumer and upon squeezing the pouch, the pouch is compressed. As the pouch is compressed, the food or other contents are urged outward through a cap or other pouch opening. Once the contents have been consumed, the compressed pouch is typically disposed of by the user, and the pouch does not rebound to its original shape when compressed.

The empty pouches are disposed of and are typically not recyclable or easily recycled. Such pouches may be made from a number of laminated layers that are bonded together. The layers may be made from for example polyester, aluminum foil, polyethylene, mylar, and paperboard. Pouches that have a laminated wall structure as described are typically not recyclable. Additionally, known pouches include caps, spouts or a sealing means that are made of other types of plastics.

Given the focus on sustainability globally and more specifically, maximizing opportunities to recycle refuse, there is a need for a squeezable plastic container that can effectively store and dispense container contents where the container is made from a material that is recyclable, is collapsible and reboundable so that an infant or any consumer may easily dispense contents from the container.

BRIEF DESCRIPTION

In one aspect of the present disclosure, a blow-molded bottle is disclosed. The bottle includes a top portion, a bottom portion and a collapsible portion disposed between the top portion and the bottom portion. The top portion, bottom portion and collapsible portion define a unitary bottle body. The collapsible portion includes opposing panels and opposing sidewalls forming a continuous wall of the collapsible portion. The opposing panels are separated by a panel distance, and the sidewalls are separated by a sidewall distance. Each of the opposing panels have a contoured shape defined by a compound curvature. The compound curvature is defined by a longitudinally extending curvature extending from a first end to a second end of the opposing panels and laterally extending curvature extends between the opposing sidewalls. The first end is adjacent to the top portion and the second end is adjacent to the bottom portion. Application of a force to the opposing panels causes the opposing panels to collapse from an uncollapsed state to a collapsed state. Non-application of the force to the opposing panels returns the opposing panels to the uncollapsed state.

In another aspect of the present disclosure, a blow-molded bottle is disclosed. The bottle includes a top portion, a bottom portion and a collapsible portion disposed between the top portion and the bottom portion. The top portion, bottom portion and collapsible portion define a unitary bottle body. The collapsible portion includes opposing panels and opposing sidewalls forming a continuous wall of the collapsible portion. The opposing panels are separated by a panel distance, and the sidewalls are separated by a sidewall distance. Each of the opposing panels having a contoured shape defined by a compound curvature. The opposing panels collapse when a force is applied to the opposing panels and the opposing panels elastically rebound upon non-application of force. The compound curvature is defined by a longitudinally extending curvature extending from a first end to a second end of the opposing panels and a laterally extending curvature extending between the opposing sidewalls. The laterally extending curvature is convex, and the longitudinally extending curvature is concave. Application of the force to the opposing panels flattens the longitudinally extending curvature and the laterally extending curve such that the compound curvature stores potential energy configured to rebound the opposing panels after non-application of force.

BRIEF DESCRIPTION OF THE DRAWINGS

The reference symbols used in the drawings, and their meanings, are listed in summary form in the list of reference symbols. In principle, identical parts are provided with the same reference symbols in the figures.

DETAILED DESCRIPTION

In the following specification and the claims, reference will be made to a number of terms, which shall be defined to have the following meanings.

As used herein, the singular forms "a," "an," and "the" include plural references unless the context clearly dictates otherwise. The terms "comprising," "including," and "having" are intended to be inclusive and mean that there may be additional elements other than the listed elements. The terms "optional" or "optionally" means that the subsequently described event or circumstance may or may not occur, and that the description includes instances where the event occurs and instances where it does not.

As used herein, the term "blow-molded bottle" refers to liquid containers made by extrusion blow molding. Flash (excess plastic as a result of the blow-molding process) may be shaved or otherwise removed from the blow-molded bottle, resulting in a seamless container having an opening. The blow-molded bottles described herein have a wall thickness of preferably 0.017 in (0.43 mm). The opening can have a threaded connection.

Embodiments of the present disclosure are directed to a blow-molded collapsible bottle which rebounds after the bottle is no longer squeezed by a user. The blow-molded bottle includes a top portion; a bottom portion; and a collapsible portion disposed between the top portion and the bottom portion. The top portion, bottom portion and collapsible portion define a unitary bottle body. The collapsible portion includes opposing panels and opposing sidewalls forming a continuous wall of the collapsible portion. The opposing panels are separated by a panel distance, and the sidewalls are separated by a sidewall distance. Each of the opposing panels have a contoured shape defined by a compound curvature. The compound curvature is defined by a longitudinally extending curvature extending from a first end to a second end of the collapsible portion and a laterally extending curvature extending between the opposing sidewalls. The laterally extending curvature is convex, and the longitudinally extending curvature is concave. Application of a force to the opposing panels causes the opposing panels to collapse from an uncollapsed state to a collapsed state. Non-application of the force to the opposing panels returns the opposing panels to the uncollapsed state. And finally, application of the force to the opposing panels flattens the longitudinally extending curvature and the laterally extending curve such that the compound curvature stores potential energy to facilitate rebounding of the opposing panels after non-application of force.

Figure 1:
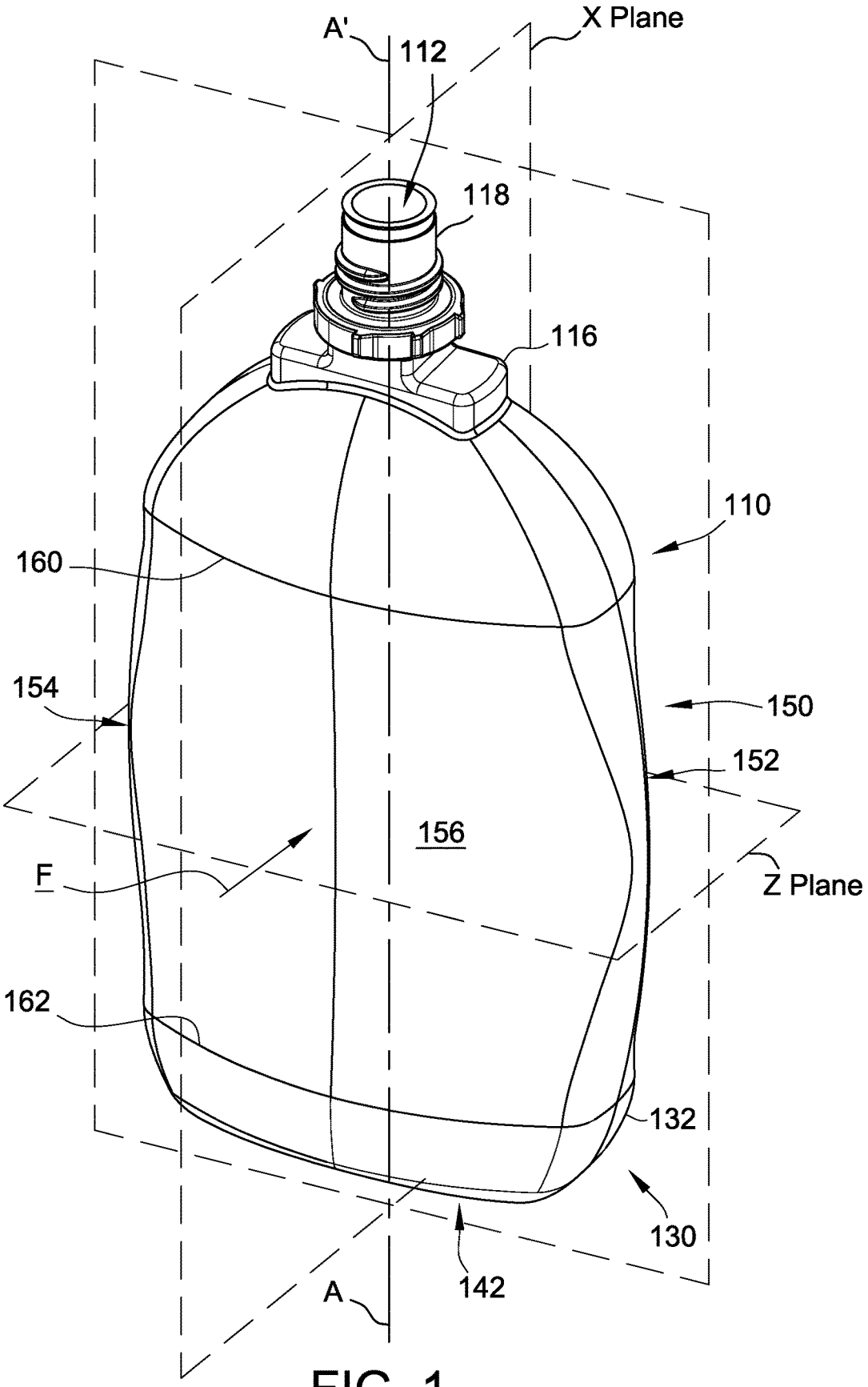
FIG. 1 illustrates a perspective view of a collapsible blow-molded bottle in accordance with embodiments of the present disclosure.

FIG. 1 illustrates a perspective view of an exemplary collapsible blow-molded bottle 100 (hereinafter referred to as "bottle 100") in accordance with embodiments of the present disclosure. The bottle can be used for cold-fill applications, hot-fill food and beverage applications or aseptic-fill applications.

The bottle 100 includes a top portion 110, a bottom portion 130 and a collapsible portion 150 disposed between the top portion 110 and the bottom portion 130. The collapsible portion 150 includes a first end 160 and a second end 162. The first end 160 and second end 162 are respectively adjacent and integral to the top portion 110 and bottom portion 130. The top portion 110, bottom portion 130 and collapsible portion 150 define a unitary bottle body. Although the ends 160, 162 are shown as a seam/end in the figures, it should be understood that these are represented in this manner for purposes of describing the exemplary embodiment of bottle 100. The top portion, bottom portion, and collapsible portion 110, 130, 150 respectively define a hollow interior cavity of the bottle. Unless stated otherwise, the bottle walls have a uniform thickness which is preferably 0.017 inches (0.43 mm).

The top portion 110 includes an opening 112, and the bottom portion 130 includes a closed end or base 142. For purposes of the description, the bottle 100 will be described in reference to X-Y-Z orientation planes identified respectively in FIG. 1 as the X-plane, the Y-plane, and the Z-plane. The X-plane extends longitudinally along the length of the bottle 100. The Y-plane extends longitudinally along the length of the bottle 100 and in an orientation that is transverse to the X-plane. The Z-plane is oriented laterally, along the width of the bottle 100 and in an orientation that is transverse to both the X-plane and Y-planes. The X-plane and Y-plane extend along a longitudinal axis A' that is shown in FIG. 1. As used herein, the term "longitudinal" denotes a plane or axis extending between the top portion 110 and the bottom portion 130, and the term "lateral" denotes a plane or axis transverse to the first, second and collapsible portions 110, 130, 150. The bottle 100 is substantially symmetrical along the A' axis relative to the X-plane and symmetrical along the A' axis relative to the Y-plane. Unless stated otherwise, features described in the present disclosure are symmetrical to the A' axis for the X-plane and Y-plane.

Figure 2:
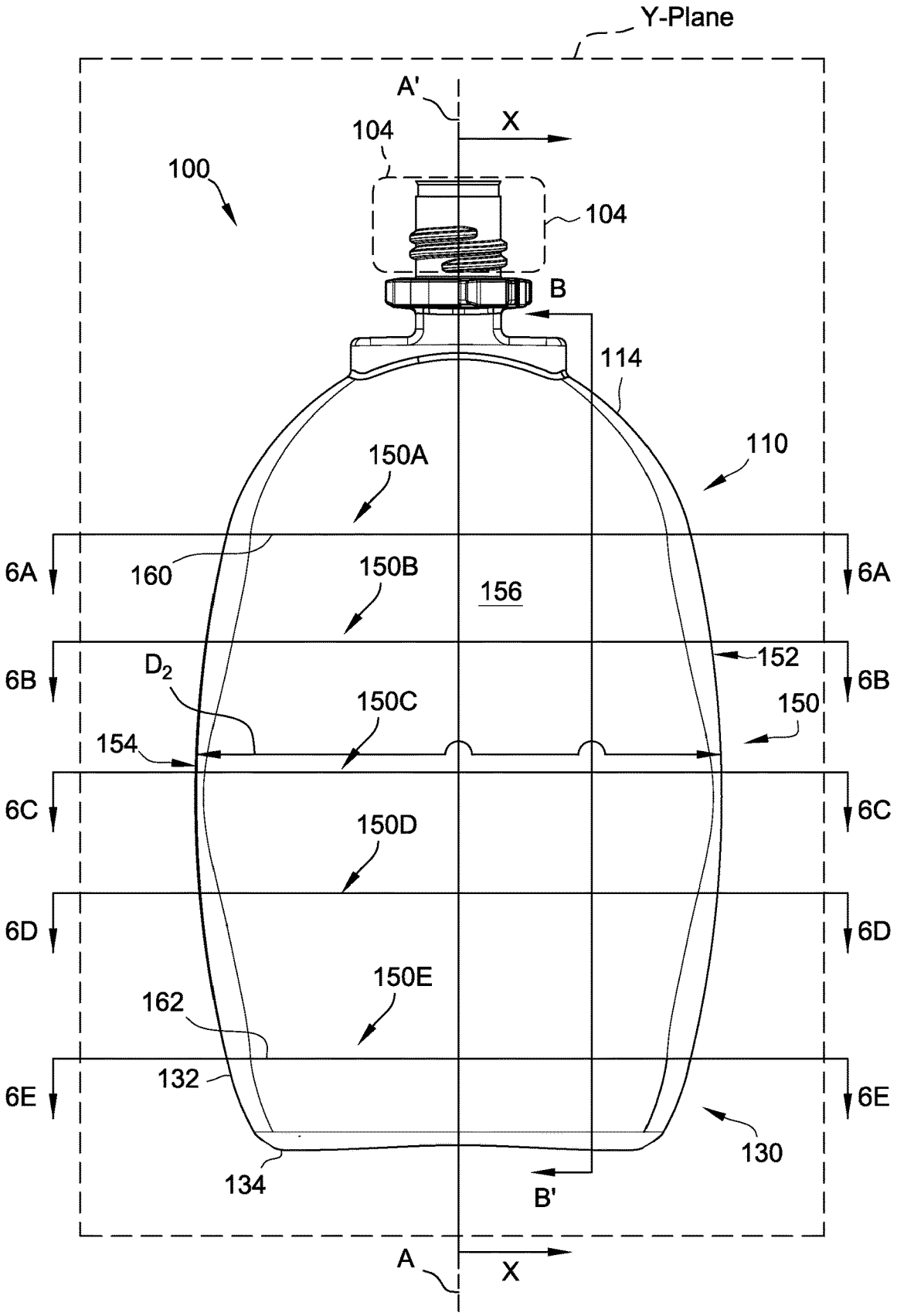
FIG. 2 illustrates a front view in a Y-plane of the collapsible blow-molded bottle of FIG. 1.
Figure 3:
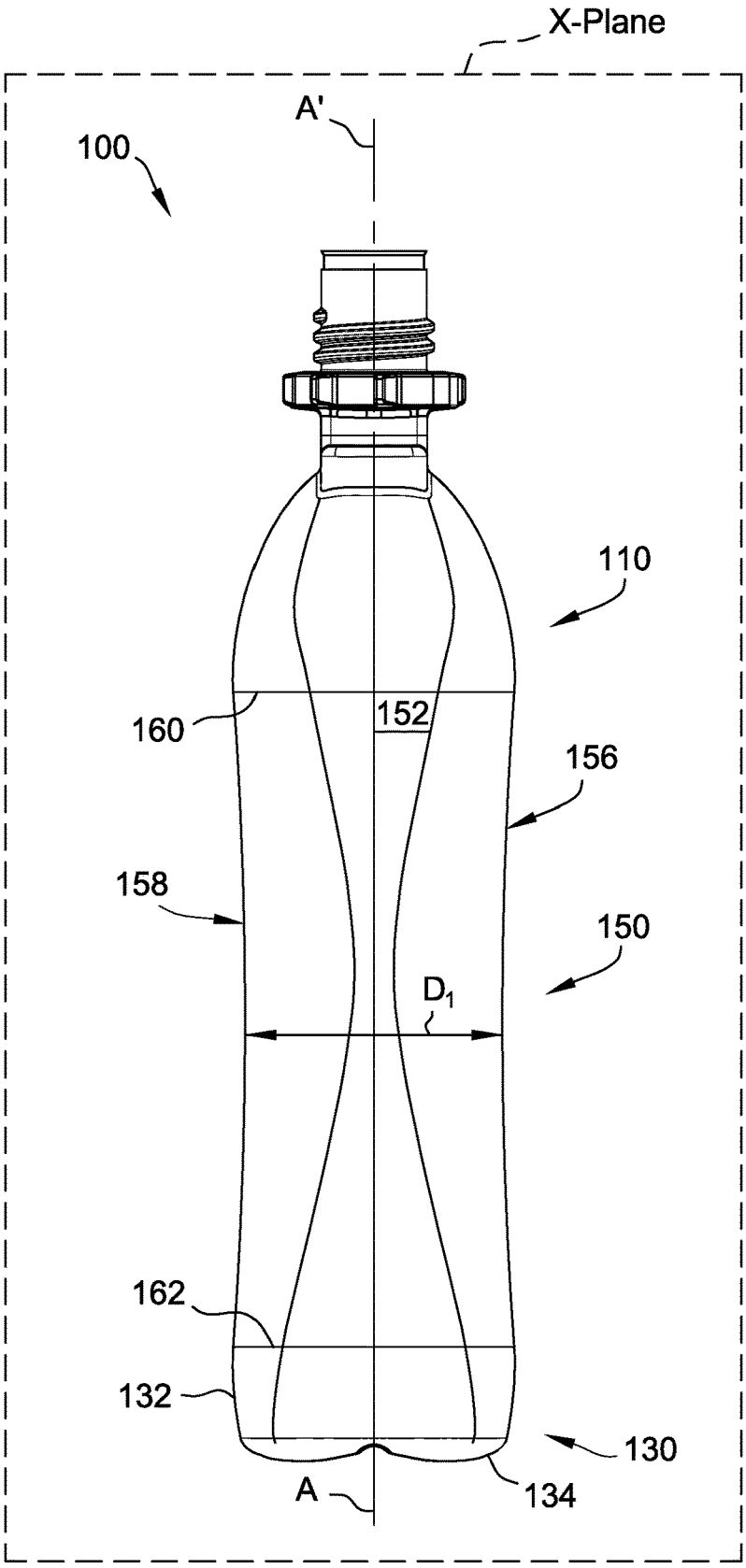
FIG. 3 illustrates a side view in an X-plane of the collapsible blow-molded bottle of FIG. 1.

FIG. 2 illustrates a front view of the bottle 100 in reference to the Y-plane and FIG. 3 illustrates a side view of the bottle 100 in reference to the X-plane. With reference to FIGS. 1 through 3, the top portion 110 comprises a convexly rounded bottle shoulder section 114 adjacent to and integral with the collapsible portion 150, an upper shoulder 116 adjacent to and integral with the convexly rounded bottle shoulder section 114, and a longitudinally extending spout 118 that terminates at an open end with opening 112. The spout is made integral with the upper shoulder 116. In some embodiments, the spout 118 includes a threaded portion configured to threadedly connect to a cap 102 having a flat top surface 104.

With reference to FIGS. 1 through 5, the bottom portion 130 includes a convexly rounded base section 132 and a substantially flat base 134 adjacent to the rounded base section 132. The flat base 134 has a bottom surface 136, and in some embodiments, the bottom surface 136 includes protuberances (not shown) for supporting the bottle 100 upright. The bottle 100 can be supported along the base upright where bottom surface 136 rests on a flat surface. In some embodiments, the bottle 100 can be stored inverted (i.e. upside down) where the top surface 104 of the cap 102 rests on the flat surface. Storing the bottle 100 inverted promotes movement of the contents of the bottle toward the opening 112 of the bottle 100.

With reference to FIGS. 1 through 5, the collapsible portion 150 includes opposing panels 156, 158 and opposing sidewalls 152, 154 forming a continuous wall of the collapsible portion 150. The opposing panels 156, 158 and opposing sidewalls 152, 154 extend between the first end 160 and the second end 162. As shown in FIG. 3, the opposing panels 156, 158 are separated by a panel distance $D_1$ in the X-plane, and as shown in FIG. 2, the opposing sidewalls 152, 154 are separated by a distance $D_2$ in the Y-plane.

Figure 4:
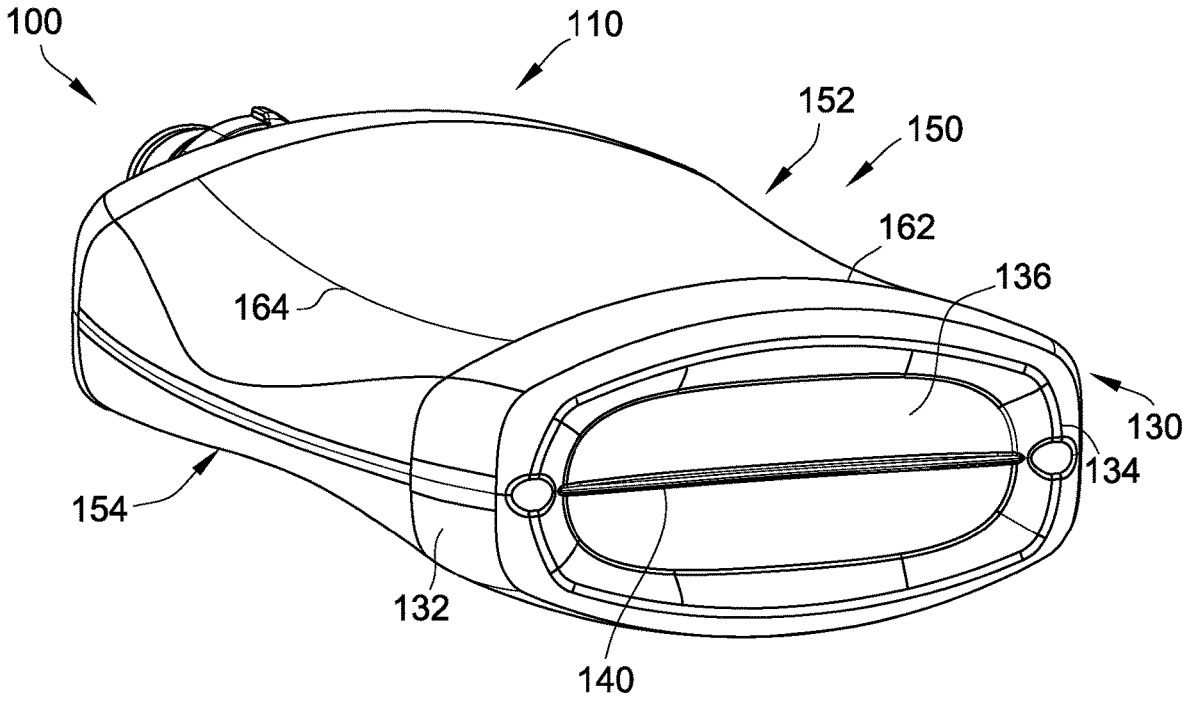
FIGS. 4 and 5 illustrate perspective views of the collapsible blow-molded bottle of FIG. 1, with emphasis of a compound curvature of the collapsible blow-molded bottle.
Figure 5:
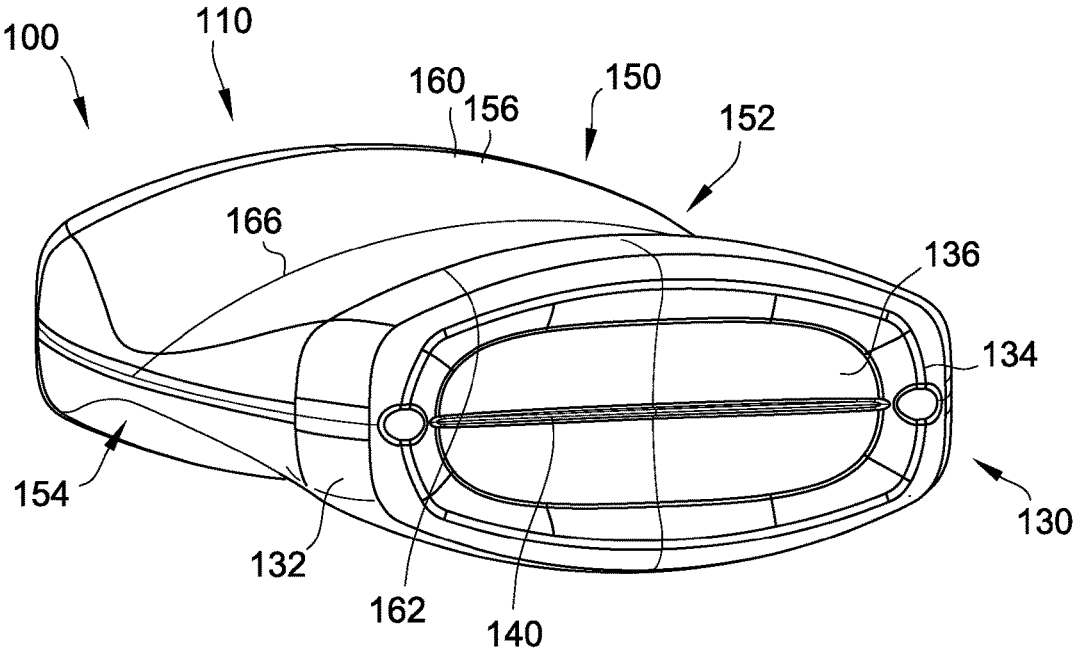

As best shown in FIGS. 4 and 5, the opposing panels 156, 158 have a contoured shape defined by a compound curvature. The compound curvature is defined by a longitudinally extending curvature 164 extending along the opposing panels 156, 158 from the first end 160 to the second end 162, and by a laterally extending curvature 166 extending between the opposing sidewalls 152, 154. As shown in FIG. 4, the longitudinally extending curvature 164 is concave and as shown in FIG. 5, the laterally extending curvature 166 is convex. As a result, the opposing panels 156, 158 together form an hourglass shape in the X-plane (as shown in FIGS. 3 and 7) and the opposing panels 156, 158 together form an ovalized shape in the Z-Plane (as shown in FIGS. 6A through 6E).

Figure 6A:
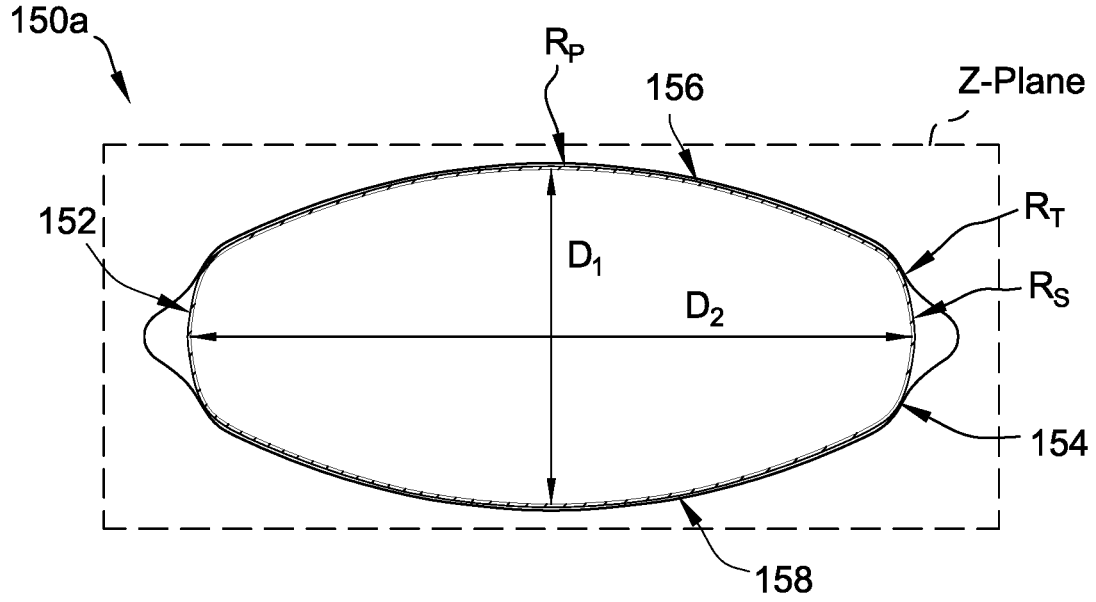
FIGS. 6A through 6E illustrate perspective cross-sectional views of the collapsible blow-molded bottle of FIG. 1 along section lines that are parallel to the exemplary Z-plane of FIG. 1 and are shown in FIG. 2.
Figure 6B:
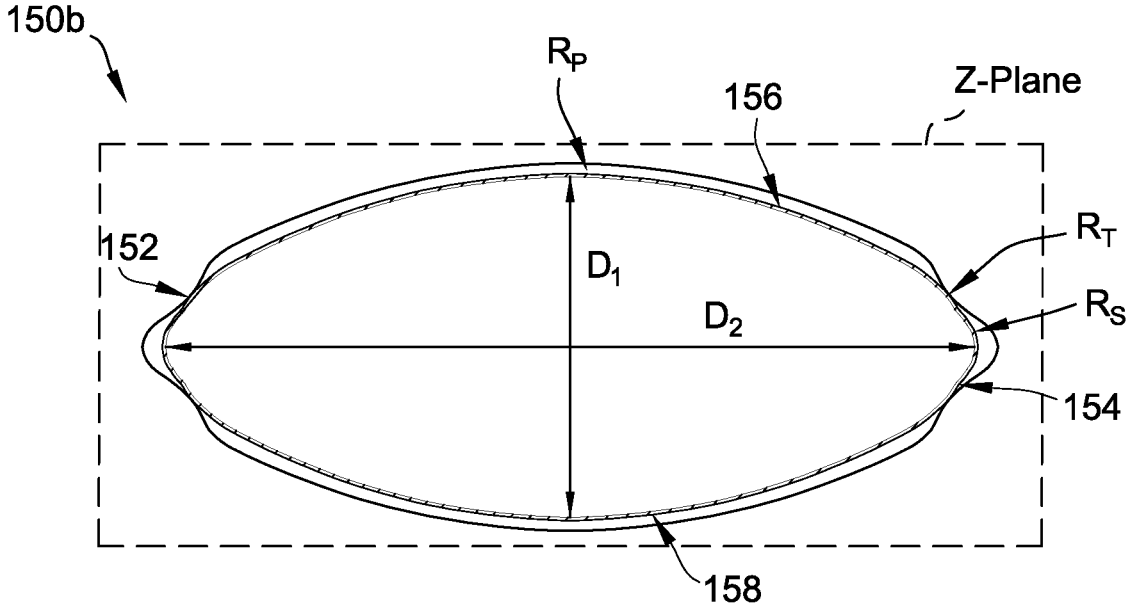
Figure 6C:
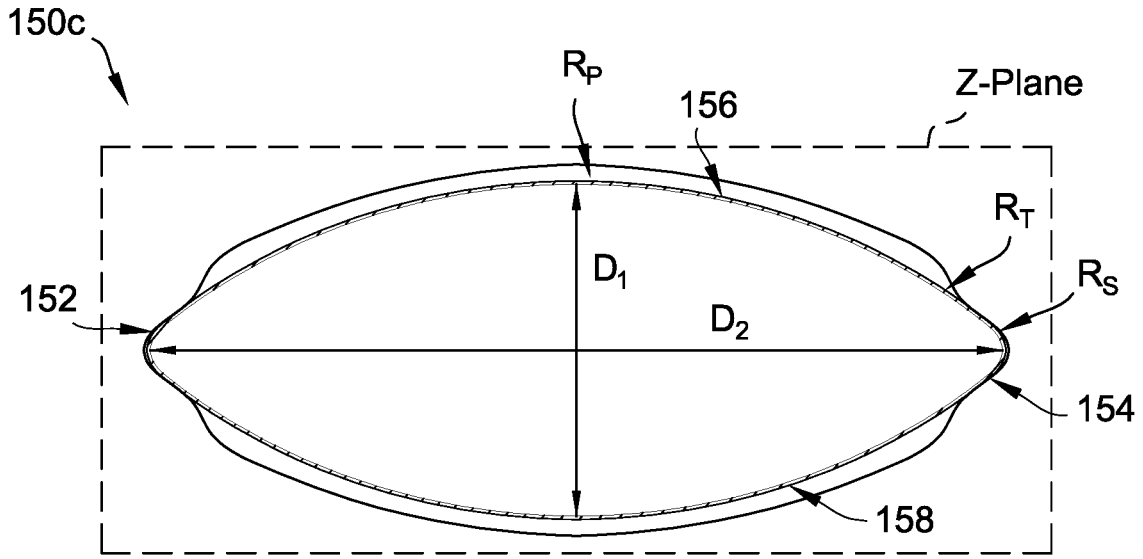
Figure 6D:
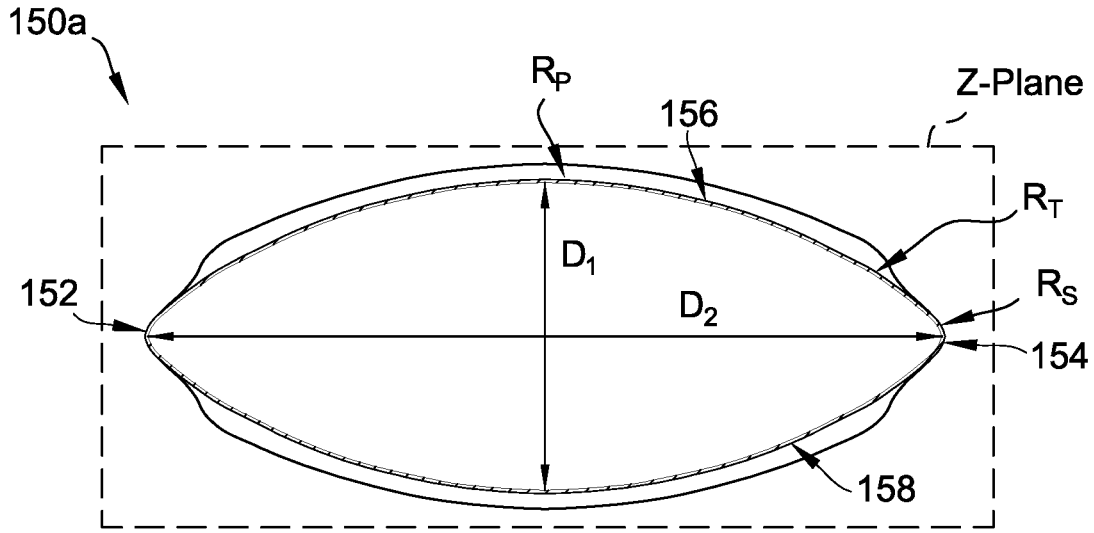
Figure 6E:
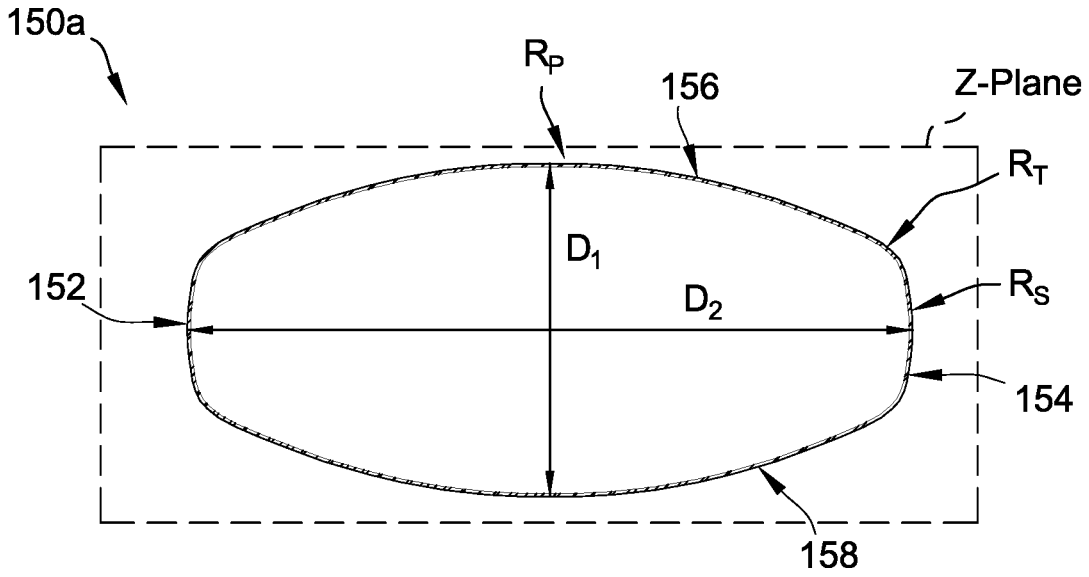
Figure 7:
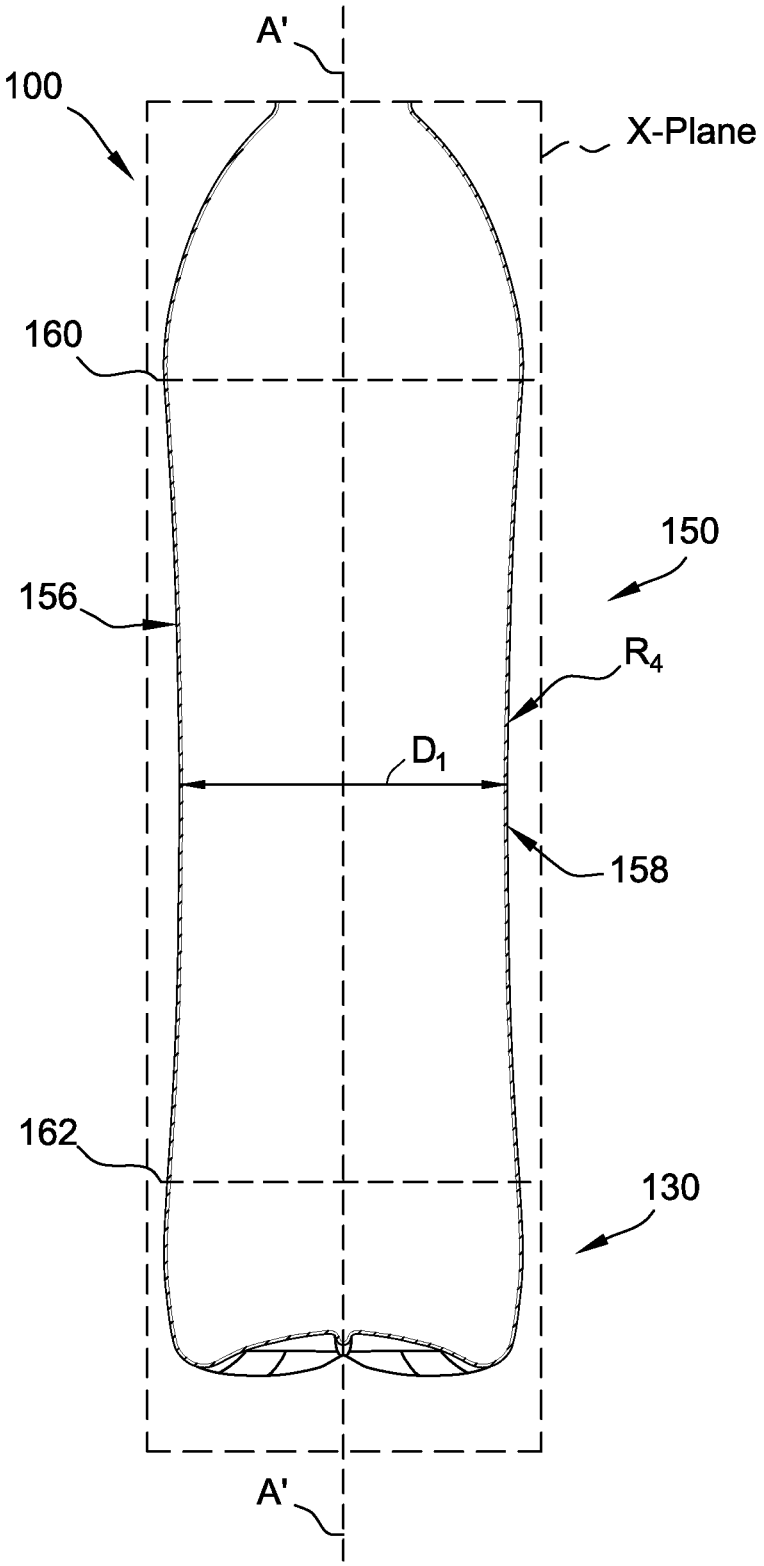
FIG. 7 illustrates a cross-sectional view of the collapsible blow-molded bottle of FIG. 1 across an X-plane that is parallel to the exemplary X-plane of FIG. 1.

FIGS. 6A through 6E illustrate cross-sectional views of the collapsible portion 150 taken along respective section lines 6A-6A' through 6E-6E'. FIG. 6A illustrates a top section 150*a* of the collapsible portion 150 taken along line 6A-6A' of FIG. 2. FIG. 6B illustrates a first section 150*b* positioned a distance from the top section 150*a* taken along line 6B-6B' of FIG. 2. FIG. 6C illustrates a middle section 150*c* of the collapsible portion 150 taken along line 6C-6C' of FIG. 2. FIG. 6D illustrates a second section 150*d* positioned a distance from the middle section 150*c* taken along line 6D-6D' of FIG. 2. FIG. 6E illustrates a bottom section 150*e* of the collapsible portion 150 taken along line 6E-6E' of FIG. 2. The first section 150*b* is between the top section 150*a* and the middle section 150*c*. Likewise, the second section 150*d* is between the middle section 150*c* and the bottom section 150*e*. The dimensional relationships of bottle 100 described below are for the bottle 100 in the uncollapsed state. As used herein, the term "middle section" denotes a cross-section that is substantially or generally equidistant between the first end 160 and the second end 162, it should be understood that in some embodiments the middle section can be at any longitudinal point between the first end and the second end to enable the bottle 100 to function as described herein.

As shown in FIG. 6C, at the middle section 150*c*, the panel distance $D_1$ is at a minimum value and the sidewall distance $D_2$ is at a maximum value. As shown in FIG. 6A, at the top section 150*a*, the panel distance $D_1$ is at a maximum value relative to the middle section 150*c*, and the sidewall distance $D_2$ is at a minimum value relative to the middle section 150*c*. As shown in FIG. 6B, at the first section 150*b* between the top section 150*a* and the middle section 150*c*, the panel distance $D_1$ is less than the maximum value of the top section 150*a* and greater than the minimum value of the middle section 150*c*, and the sidewall distance $D_2$ is greater than the minimum value of the top section 150*a* and less than the maximum value of the middle section 150*c*.

Similar to the top section 150*a*, as shown in FIG. 6E, at the bottom section 150*e*, the panel distance $D_1$ is at a maximum value and the sidewall distance $D_2$ is at a minimum value relative to the middle section 150*c*. Similar to the first section 150*b*, the panel distance $D_1$ is less than the maximum value of the bottom section 150*e* and greater than the minimum value of the middle section 150*c*, and the sidewall distance $D_2$ is greater than the minimum value of the bottom section 150*e* and less than the maximum value of the middle section 150*c*.

The contour of the collapsible portion 150 varies along longitudinal axis A, between the first end 160 and second ends 162. More specifically, the panel distance $D_1$ varies between the first and second ends 160, 162. The panel distance $D_1$ is narrowed as the collapsible portion 150 extends from the first end 160 longitudinally toward the middle of the collapsible portion, and the panel distance $D_1$ is expanded as the collapsible portion extends longitudinally from the middle of the collapsible portion toward the second end 162. Additionally, the sidewall distance $D_2$ varies between the first and second ends 160, 162. The sidewall distance $D_2$ is expanded as the collapsible portion 150 extends from the first end 160 longitudinally toward the middle of the collapsible portion, and the sidewall distance $D_2$ is narrowed as the collapsible portion extends longitudinally from the middle of the collapsible portion 150 toward the second end 162.

The panel distance $D_1$ is in the range of 20 mm (0.79 in) to 80 mm (3.15 in) and the sidewall distance $D_2$ is in the range of 50 mm (1.97 in) to 165 mm (6.50 in).

At the top section 150*a*, the panel distance $D_1$ is preferably 58.1 mm (2.29 in) and the sidewall distance $D_2$ is preferably 28.2 mm (1.11 in). At the middle section 150*c*, the panel distance $D_1$ is preferably 65.7 mm (2.59 in) and the sidewall distance $D_2$ is preferably 25.8 mm (1.02 in). At the bottom section 150*e*, the panel distance $D_1$ is preferably 58.1 mm (2.29 in) and the sidewall distance $D_2$ is preferably 28.2 mm (1.11 in).

A ratio of the panel distance $D_1$ at the top section 150*a* to the panel distance $D_1$ at the middle section 150*c* is preferably 0.88, and in the range of 0.75 to 0.95, and wherein a ratio of the sidewall distance $D_2$ at the top section 150*a* to the sidewall distance $D_2$ at the middle section 150*c* is preferably 0.91, and in the range of 0.85 to 0.95.

A ratio of the panel distance $D_1$ at the bottom section 150*e* to the panel distance $D_1$ at the middle section 150*c* is preferably 0.88, and in the range of 0.85 to 0.95, and wherein a ratio of the sidewall distance $D_2$ at the bottom section 150*e* to the sidewall distance $D_2$ at the middle section 150*c* is preferably 0.91, and in the range of 0.85 to 0.95.

A ratio of the panel distance $D_1$ to the sidewall distance $D_2$ at the top section 150*a* is preferably 0.58, and in the range of 0.55 to 0.65

A ratio of the panel distance $D_1$ to the sidewall distance $D_2$ at the bottom section 150*e* is preferably 0.39, and in the range of 0.35 to 0.45

A ratio of the panel distance $D_1$ to the sidewall distance $D_2$ at the middle section 150*c* is preferably 0.58, and in the range of 0.55 to 0.65

As shown in FIGS. 6A through 6E, for each section (150*a*, 150*b*, 150*c*, 150*d*, 150*e*), the opposing panels 156, 158 have a panel radius $R_P$, and the opposing sidewalls 152, 154 have a sidewall radius $R_S$. At transitions between the opposing panels 156, 158 and the opposing sidewalls 152, 154, the continuous wall of the collapsible portion has a transition radius $R_T$ between the sidewall radius $R_S$ and the panel radius $R_P$.

As shown in FIG. 6C, at the middle section 150*c*, the panel radius $R_P$ is at a maximum value, the sidewall radius $R_S$ is at a minimum value and the transition radius $R_T$ is at a maximum value such that the transition radius forms a substantially planar segment.

As shown in FIG. 6A, at the top section 150*a*, the panel radius $R_P$ is at a minimum value relative to the middle section 150*c*, the sidewall radius $R_S$ is at a maximum value relative to the middle section 150*c*, and the transition radius $R_T$ is at a minimum relative to the middle section 150*c*.

As shown in FIG. 6B, at the first section 150*b*, the panel radius $R_P$ is greater than the minimum value of the top section 150*a* and less than the maximum value of the middle section 150*c*, the sidewall radius $R_S$ is less than the maximum value of the top section 150*a* and greater than the minimum value of the middle section 150*c*, and the transition radius $R_T$ is greater than the minimum value of the top section 150*a* and less than the maximum value of the middle section 150*c*.

As shown in FIG. 6E, at the bottom section 150*e*, the panel radius $R_P$ is at a minimum value relative to the middle section 150*c*, the sidewall radius $R_S$ is at a maximum value relative to the middle section 150*c*, and the transition radius $R_T$ is at a minimum relative to the middle section 150*c*.

As shown in FIG. 6D, at the second section 150*d*, the panel radius $R_P$ is greater than the minimum value of the bottom section 150*e* and less than the maximum value of the middle section 150*c*, the sidewall radius $R_S$ is less than the maximum value of the bottom section 150*e* and greater than the minimum value of the middle section 150*c*, and the transition radius $R_T$ is greater than the minimum value of the bottom section 150*e* and less than the maximum value of the middle section 150*c*.

FIG. 7 illustrates a cross-sectional view of the bottle 100 across an X-plane that is parallel to the exemplary X-plane of FIG. 1. In particular, FIG. 7 is a cross-section taken at the lateral middle of the collapsible portion 150. The lateral middle is defined by the plane equidistant from the opposing sidewalls 152, 154 as shown in FIG. 2. The panel distance $D_1$ varies at any point along the longitudinal axis A'. At the cross-section, the opposing panels 156, 158 have a middle radius $R_6$ between the first end 160 and the second end 162.

With reference to FIGS. 1 through 3 and 8, when the bottle 100 is squeezed by an infant or a consumer, and application of forces F to the opposing panels 156, 158 causes the opposing panels 156, 158 to collapse. As a result, the panel distance $D_1$ between the opposing panels 156, 158 of FIG. 3 decrease to a fully collapsed panel distance $D_3$ defining a collapsed state of the bottle 100. Furthermore, in the collapsed state, the curved contour shape of the opposing panels 156, 158 is flattened such that the opposing panels 156, 158 are substantially flat, and the longitudinal curvature 164 and the laterally extending curvature 166 of FIGS. 4 and 5 are substantially flat.

Application of forces F to the opposing panels 156, 158 stores potential energy within the collapsible portion 150 such that the opposing panels 156, 158 (and the collapsible portion 150 generally)—rebound after non-application of force. When the forces F are no longer applied to the opposing panels 156, 158, the flattened compound curvature causes the opposing panels 156, 158 to "spring back" and elastically rebound, thereby returning the bottle to the uncollapsed state.

The spring-back effect of the opposing panels 156, 158 is achieved by elastic potential energy stored within the collapsible portion 150 due to application of the forces F to the opposing panels 156, 158. The stored elastic potential energy creates sufficient bounce-back to return the opposing panels 156, 158 to the normal upon releasing (non-application) of the applied forces F.

In particular, the opposing panels 156, 158 exhibit a flexural behavior having a single degree of freedom subject to uniaxial bending due to the compound curvature shape of the opposing panels 156, 158. This flexural behavior functions similar to a biasing element or spring which tends to elastically rebound after non application of forces. Thus, flattening of the collapsible portion 150 stores elastic potential energy in the opposing panels 156, 158, and the non-application of forces F releases the elastic potential energy, converting it to kinetic energy.

Figure 8:
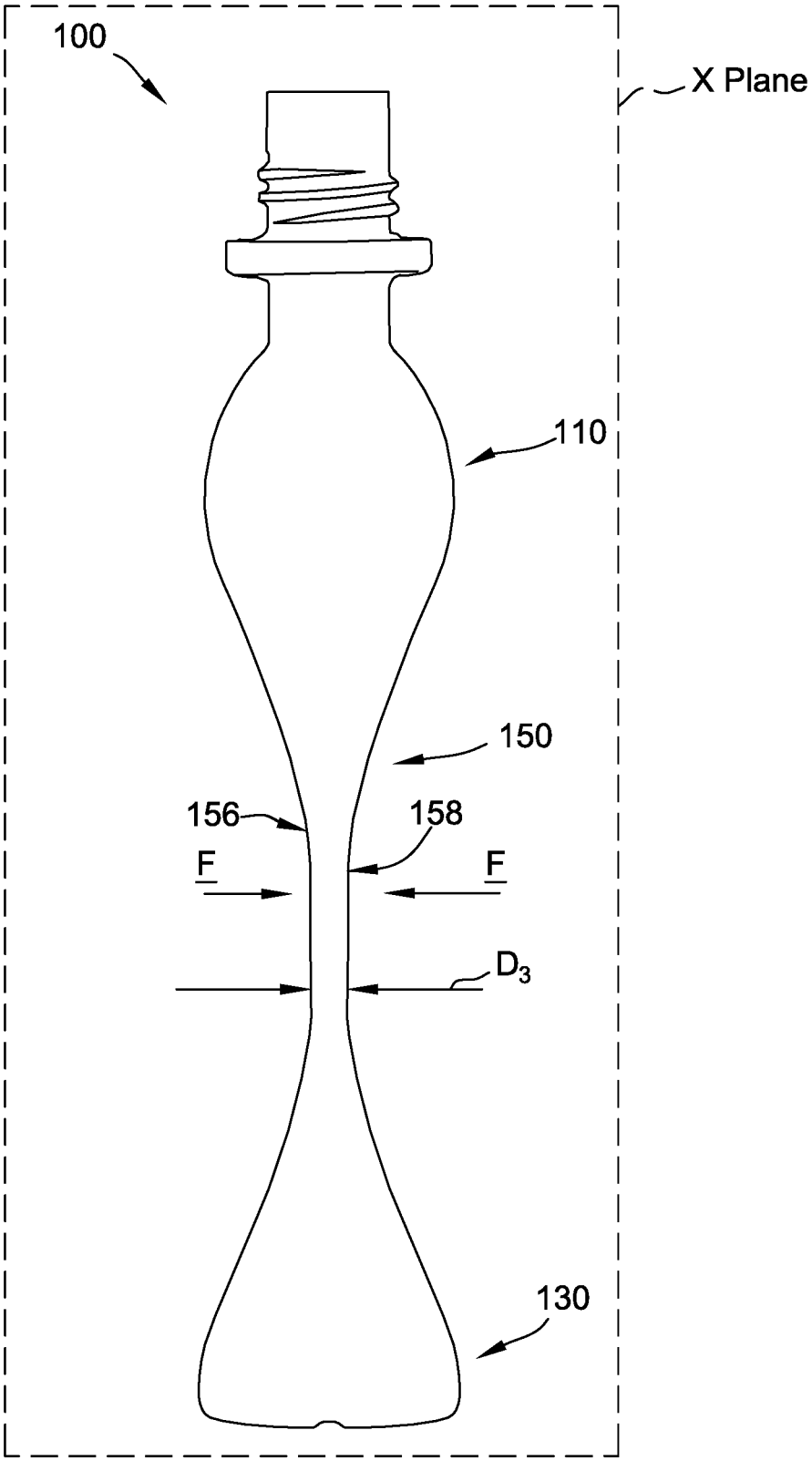
FIG. 8 illustrates a side view of a collapsible blow-molded bottle in a partially collapsed state in accordance with one or more embodiments of the present disclosure.
Figure 9:
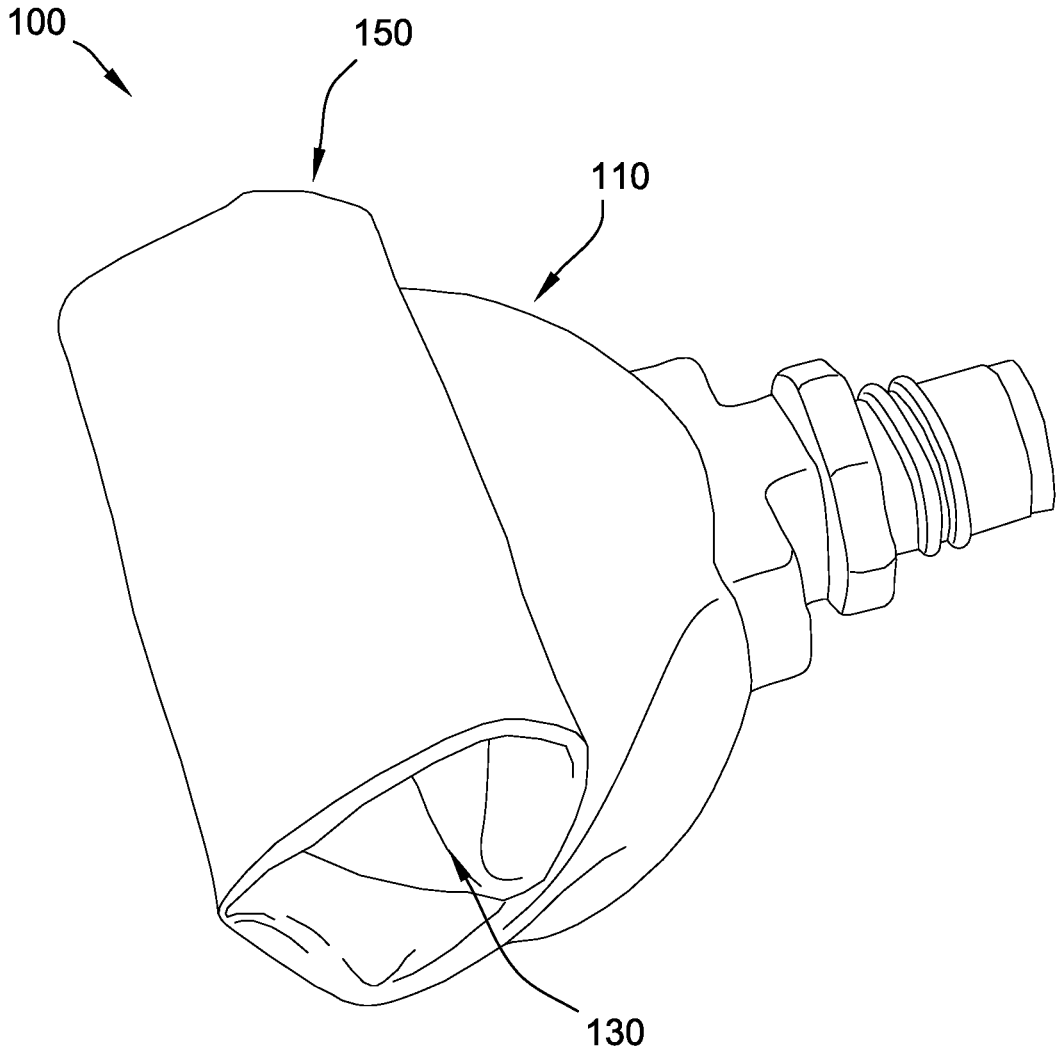
FIG. 9 illustrates a perspective view of a collapsible blow-molded bottle with the bottle body collapsed and at least partially rolled up.

FIG. 8 illustrates the collapsed state where the top portion 110 and bottom portion 130 are not fully collapsed, and the opposing panels 156, 158 are at least partially collapsed. In the collapsed state, the laterally extending curvature 166 is substantially flat. In some embodiments, the first and bottom portions may also be collapsed. As shown, the bottle 100 can be at least partially rolled up to a rolled-up state such that the bottom portion 130 and collapsible portion 150 are rollable into and towards the top portion 110. See FIG. 9.

The bottles disclosed herein can be made from food grade plastic polyolefin materials such as polypropylene, high-density polyethylene (HDPE) or low-density polyethylene (LDPE) using a conventional extrusion blow molding process.

Figure 10:
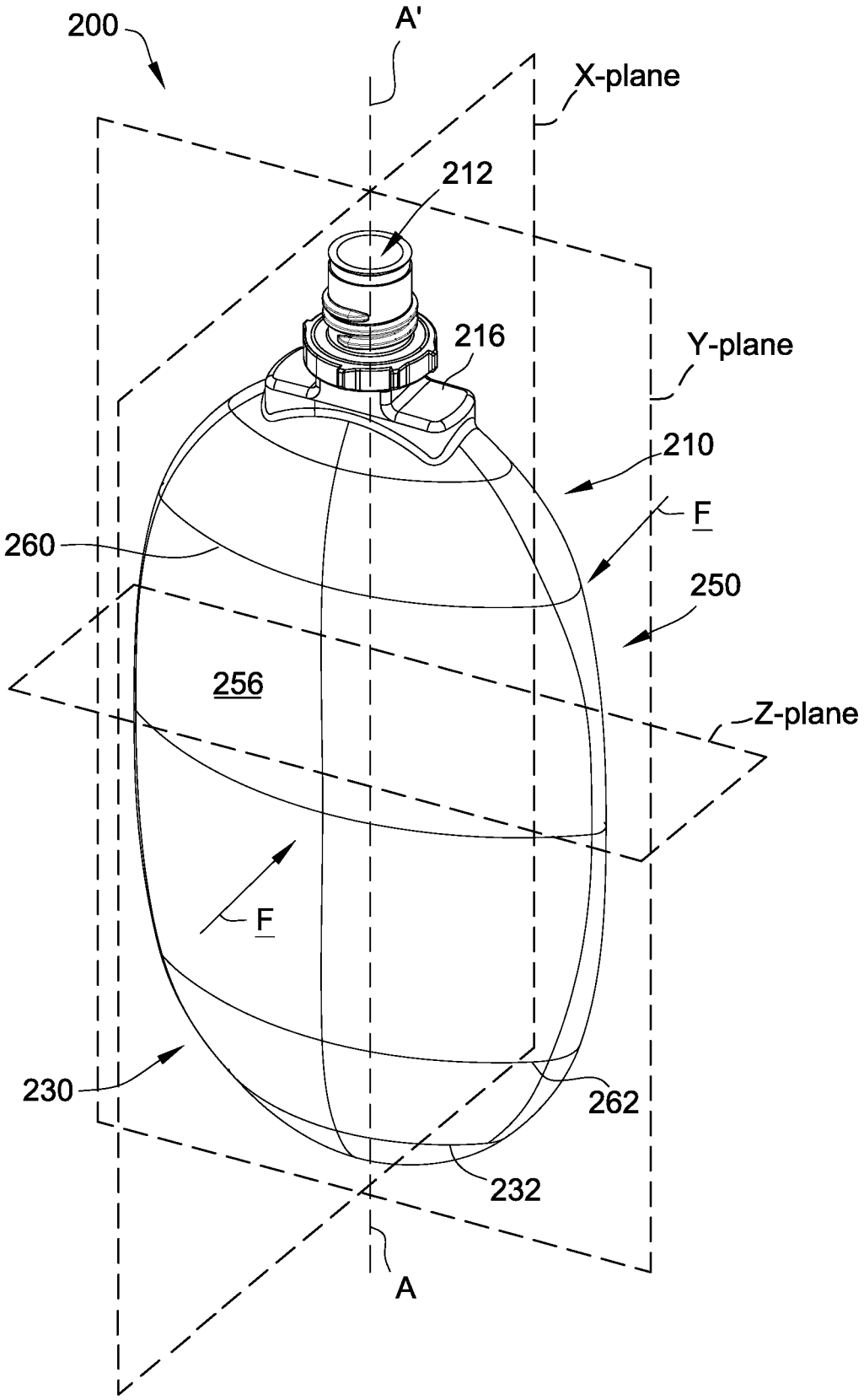
FIG. 10 illustrates a perspective view of an alternative embodiment of a collapsible blow-molded bottle having a rounded base.
Figure 11:
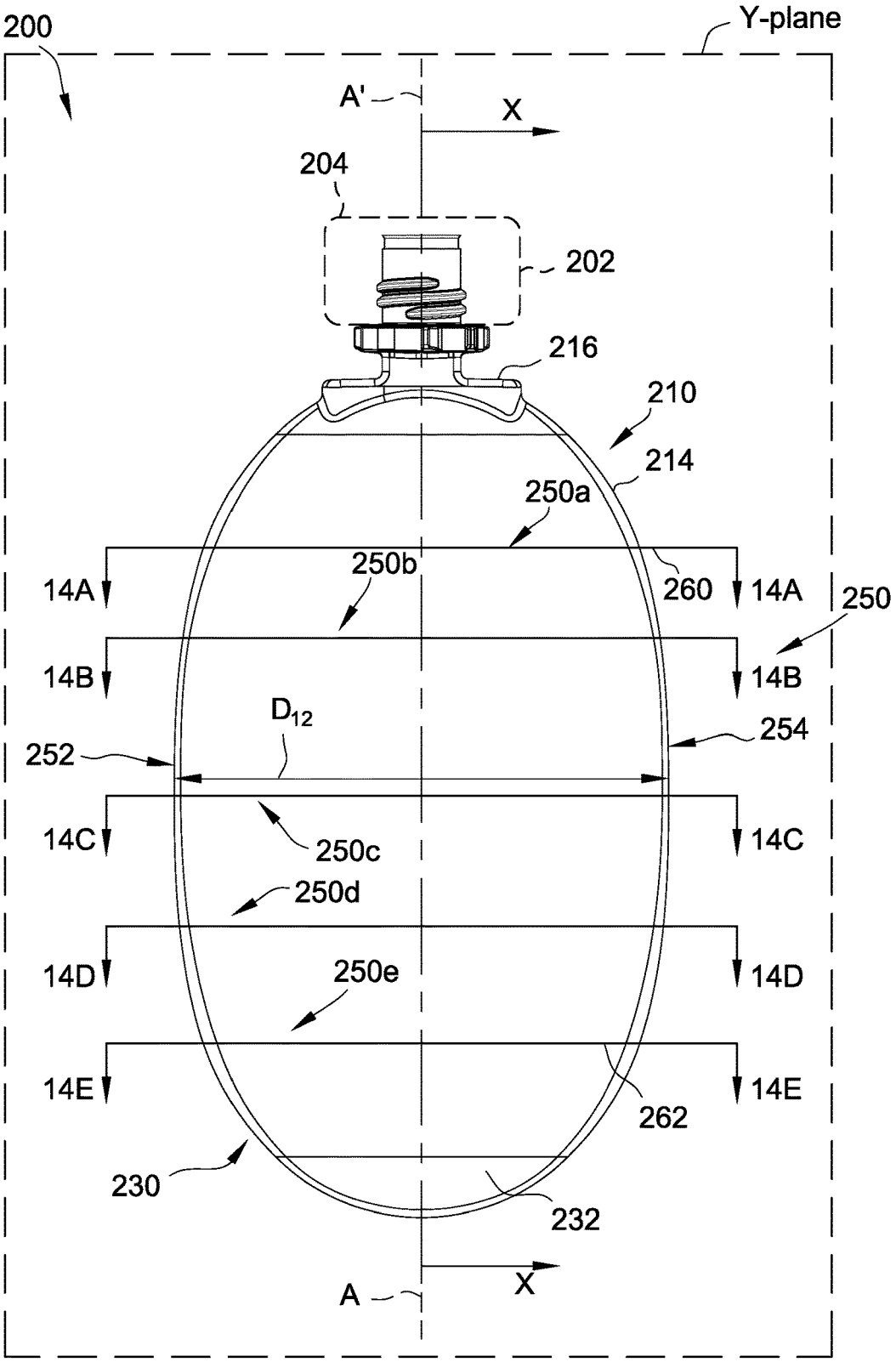
FIG. 11 illustrates a front view in a Y-plane of the collapsible blow-molded bottle of FIG. 10.
Figure 12:
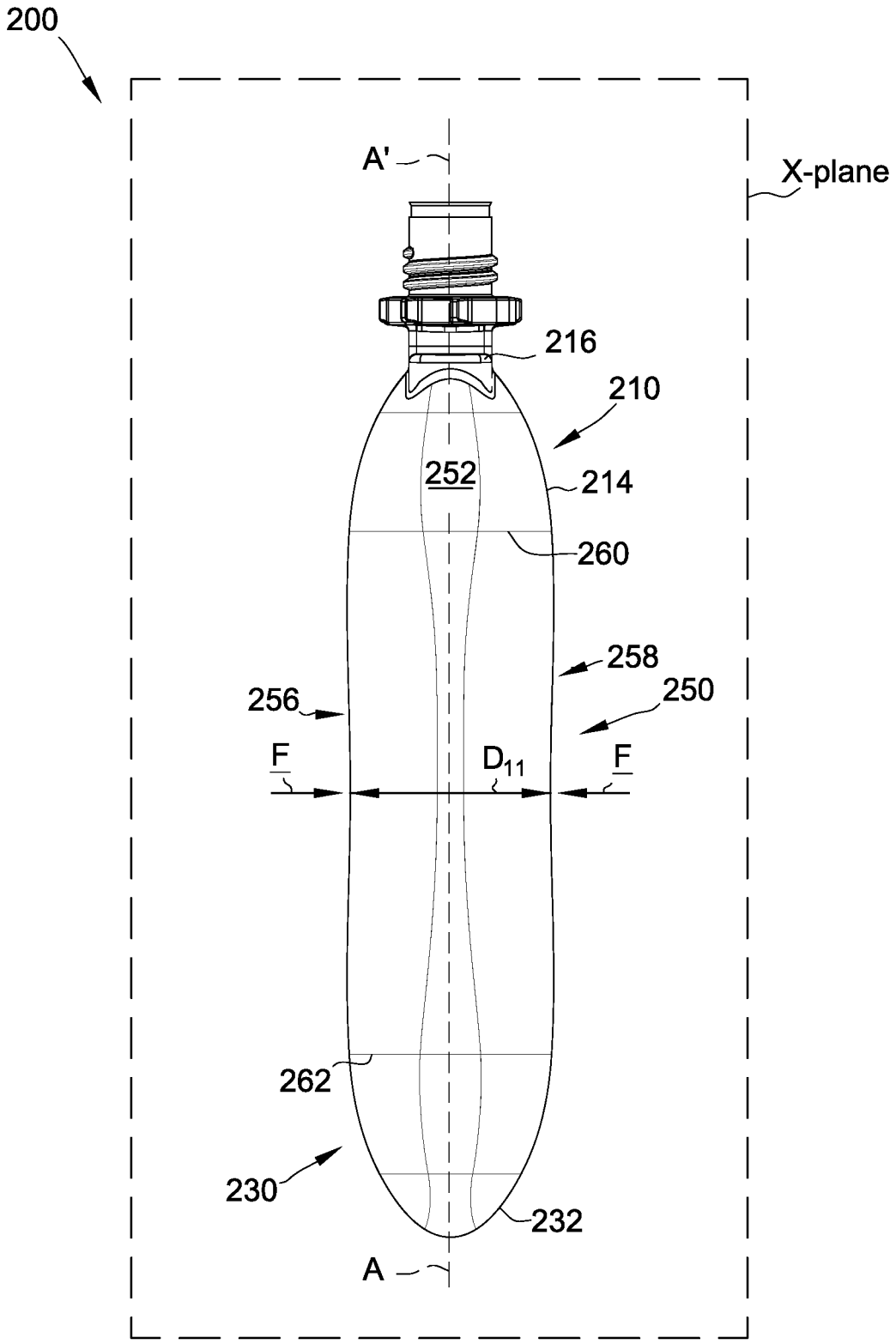
FIG. 12 illustrates a side view in an X-plane of the collapsible blow-molded bottle of FIG. 10.

FIG. 10 illustrates a perspective view of an exemplary collapsible blow-molded bottle 200 (hereinafter referred to as "bottle 200") having a rounded base in accordance with embodiments of the present disclosure. The bottle 200 includes a top portion 210, a bottom portion 230 and a collapsible portion 250 disposed between the top portion 210 and the bottom portion 230. The collapsible portion 250 includes a first end 260 and a second end 262 adjacent to and integral with the top portion 210 and bottom portion 230 respectively such that the top portion 210, the bottom portion 230 and the collapsible portion 250 define a unitary bottle body. Although the ends 260, 262 are shown as a seam/end in the figures, it should be understood that these are represented in this manner for purposes of describing the exemplary embodiment of bottle 200. In some embodiments, the bottle 200 is seamless as a result of the blow-molding process. The top portion, bottom portion, and collapsible portions 210, 230 and 250 respectively define a hollow interior cavity of the bottle. Unless stated otherwise, the bottle walls have a uniform thickness which is preferably 0.017 in (0.43 mm). As best shown in FIGS. 11 and 12, the bottle 200 is symmetrical along the longitudinal A' axis relative to the X-plane and symmetrical along the longitudinal A' axis relative to the Y-plane.

FIG. 11 illustrates a front view of the bottle 200 oriented in reference to the Y-plane and FIG. 12 illustrates a side view of the bottle 200 oriented in reference to the X-plane. With reference to FIGS. 10 through 12, the top portion 210 comprises a convexly rounded bottle shoulder section 214 adjacent to and integral with the collapsible portion 250, an upper shoulder 216 adjacent to and integral with the convexly rounded bottle shoulder section 214, and a longitudinally extending spout 218 that terminates at an open end with opening 212. The spout is made integral with the upper shoulder 216. In some embodiments, the spout 218 includes a threaded portion configured to threadedly connect to a cap 202 having a flat top surface 204.

With reference to FIGS. 10 through 13, the bottom portion 230 includes an ovalized base section 232 having a dome shape (also referred to as an oval or half-oval shape).

Because the bottle 200 has an ovalized base section 232, the bottle 200 may be stored in an inverted orientation (i.e. upside down) where the top surface 204 of the cap 202 rests on a flat surface. Storing the bottle 200 inverted promotes movement of the contents of the bottle toward the opening 212 of the bottle 200. The dome shape of the ovalized base section 232 promotes the full collapsibility of the bottle 200, which allows for the full evacuation of contents stored within the bottle 200.

With reference to FIGS. 10 through 13, the collapsible portion 250 includes opposing panels 256, 258 and opposing sidewalls 252, 254 forming a continuous wall of the collapsible portion 250. The opposing panels 256, 258 and opposing sidewalls 252, 254 extend between the first end 260 and the second end 262. As shown in FIG. 12, the opposing panels 256, 258 are separated by a panel distance $D_{11}$ represented in the X-plane, and as shown in FIG. 11, the opposing sidewalls 252, 254 are separated by a distance $D_{12}$ represented in the Y-plane.

Figure 13:
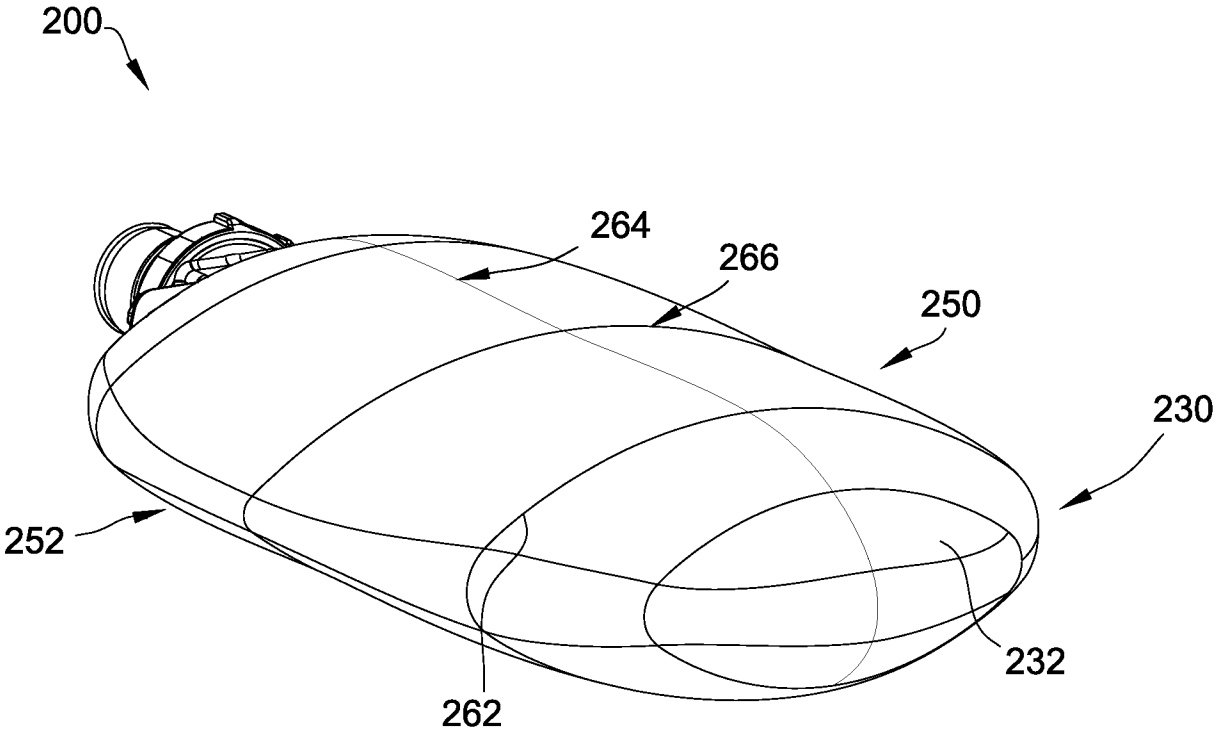
FIG. 13 illustrates a perspective view of the collapsible blow-molded bottle of FIG. 10, with emphasis of a compound curvature of the collapsible blow-molded bottle.

As best shown in FIG. 13, the opposing panels 256, 258 have a contoured shape defined by a compound curvature. The compound curvature is defined by a longitudinally extending curvature 264 extending along the opposing panels 256, 258 from the first end 260 to the second end 262, and by a laterally extending curvature 266 extending between the opposing sidewalls 252, 254. The longitudinally extending curvature 264 is concave and the laterally extending curvature 266 is convex. As a result, the opposing panels 256, 258 together form an hourglass shape as oriented in the X-plane (as shown in FIGS. 12 and 15) and the opposing panels 256, 258 together form an ovalized shape as oriented in the Z-Plane (as shown in FIGS. 14A through 14E).

Figure 14A:
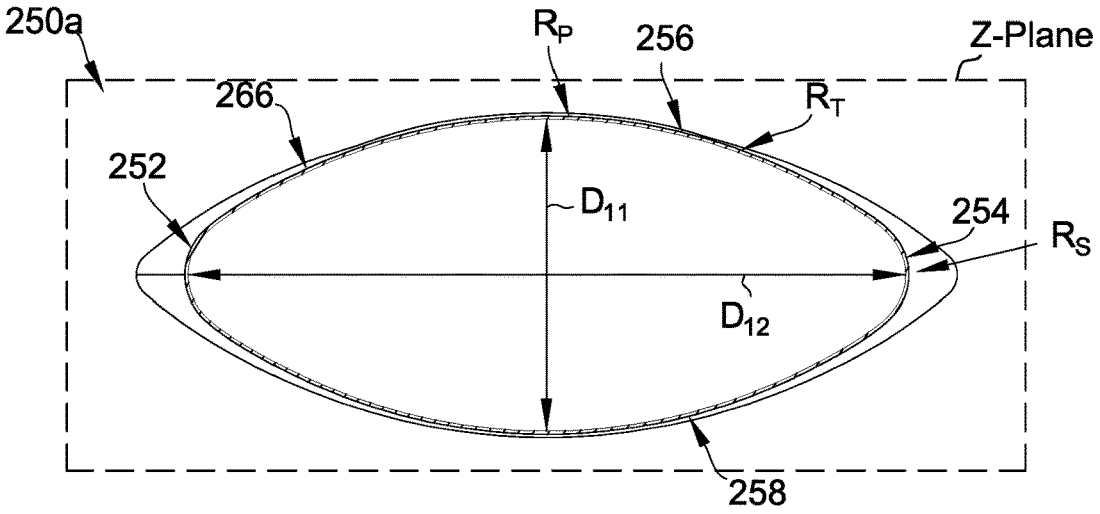
FIGS. 14A through 14E illustrate perspective cross-sectional views of the collapsible blow-molded bottle of FIG. 11 across a Z-plane parallel to the exemplary Z-plane of FIG. 10.
Figure 14B:
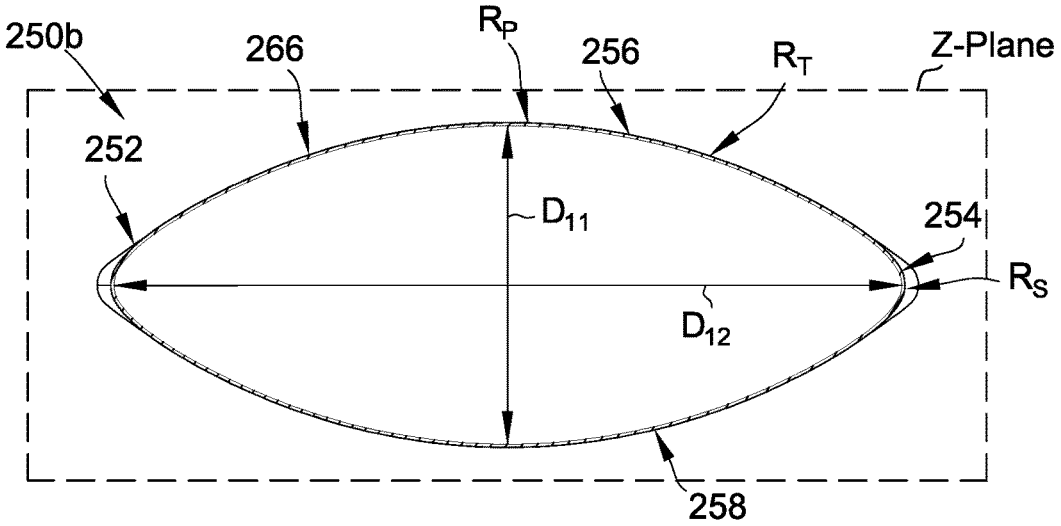
Figure 14C:
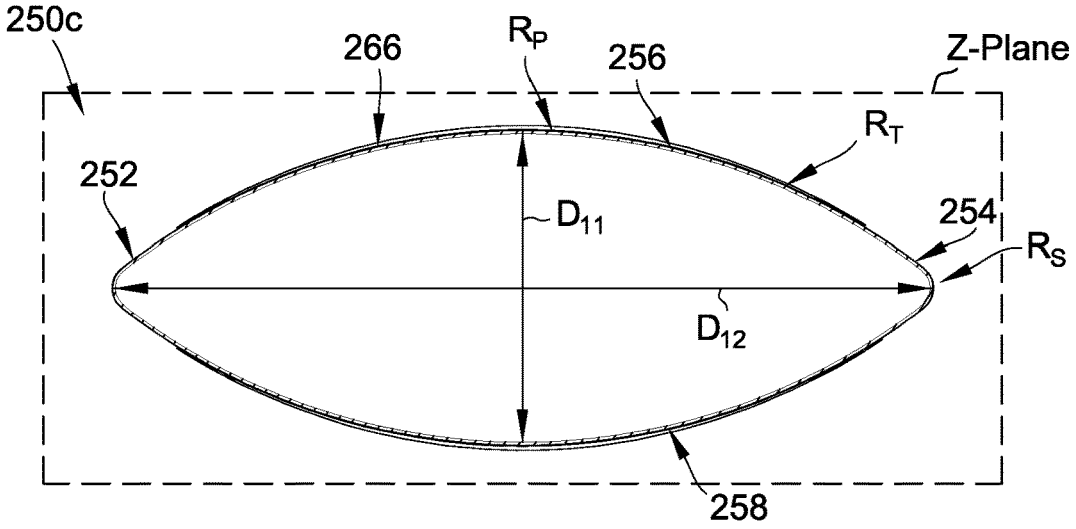
Figure 14D:
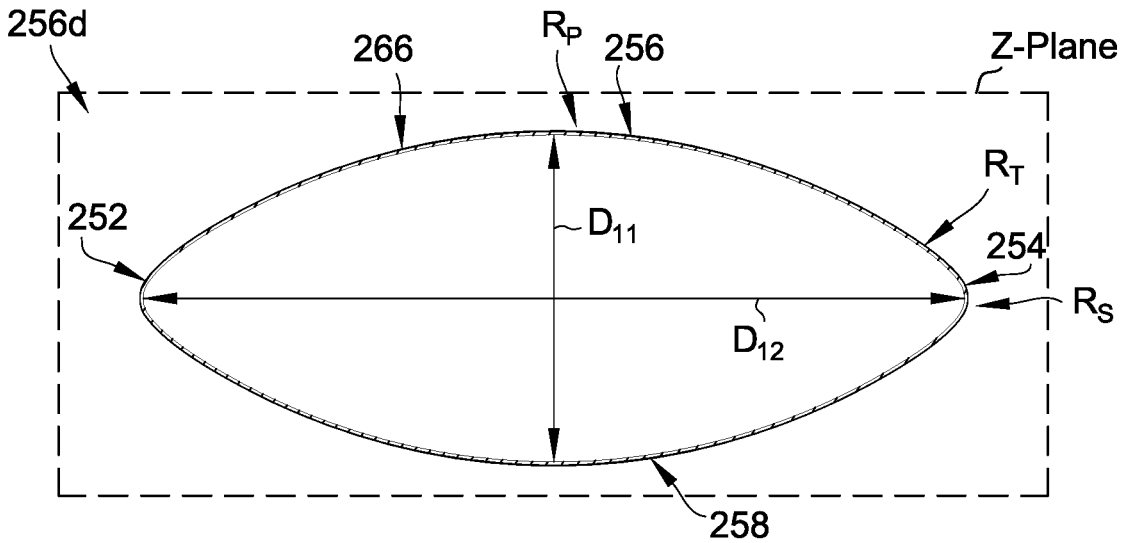
Figure 14E:
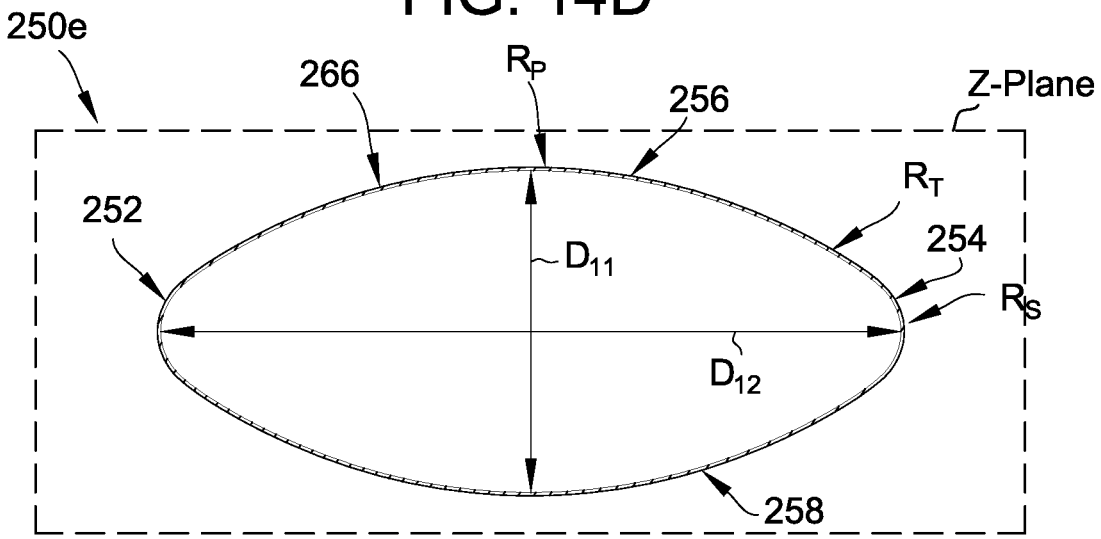
Figure 15:
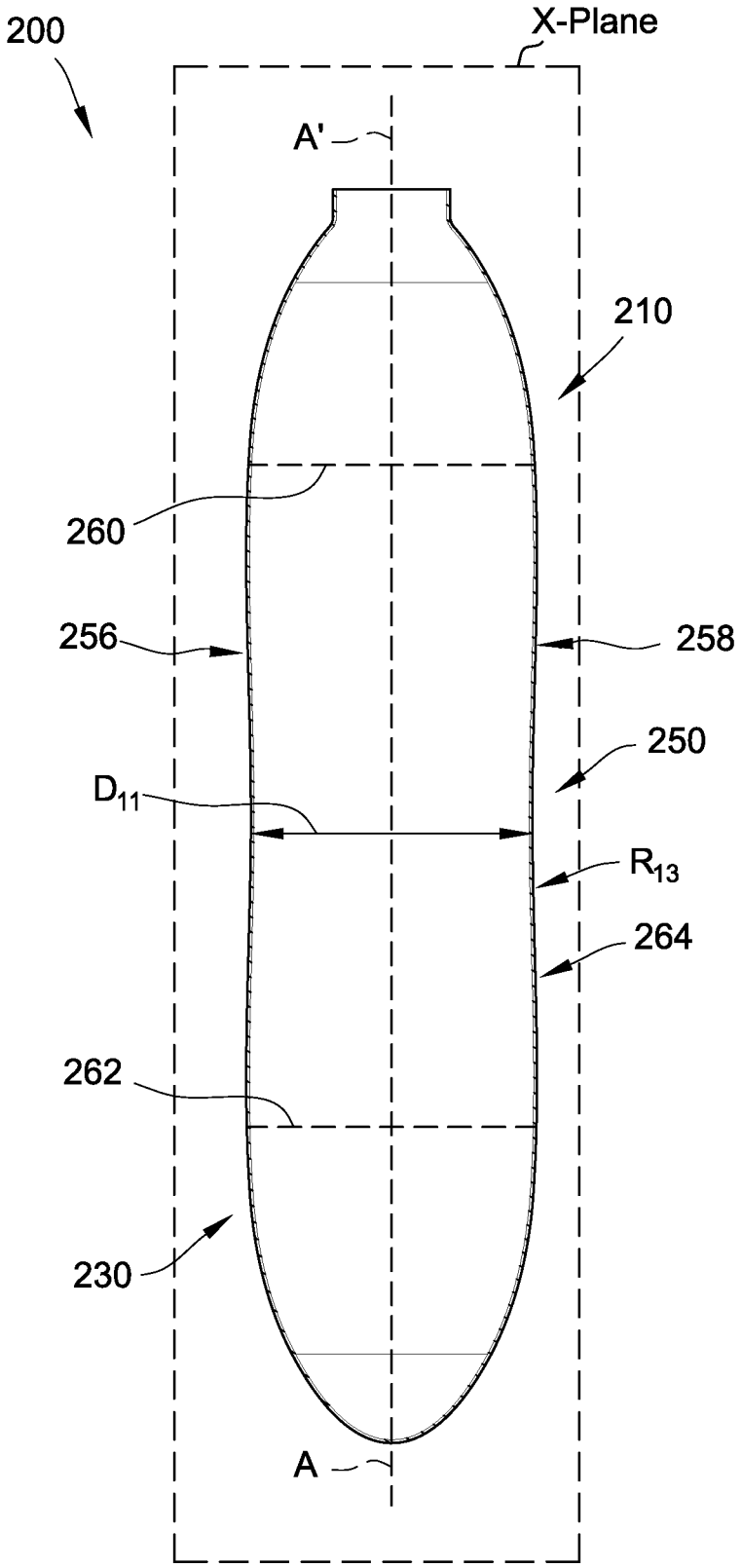
FIG. 15 illustrates a cross-sectional view of the collapsible blow-molded bottle of FIG. 10 across an X-plane that is parallel to the exemplary X-plane of FIG. 10.

FIGS. 14A through 14E illustrate cross-sectional views of the collapsible portion 250 taken in planes that are parallel to the Z-plane shown in FIG. 11. FIG. 14A illustrates a top section 250*a* of the collapsible portion 250 taken along line 14A-14A' of FIG. 11. FIG. 14B illustrates a first section 250*b* positioned a distance from the top section 250*a* taken along line 14B-14B' of FIG. 11. FIG. 14C illustrates a middle section 250*c* of the collapsible portion 250 taken along line 14C-14C' of FIG. 11. FIG. 14D illustrates a second section 250*d* positioned a distance from the middle section 250*c* taken along line 14D-14D' of FIG. 11. FIG. 14E illustrates a bottom section 250*e* of the collapsible portion 250 taken along line 14E-14E' of FIG. 11. The first section 250*b* is between the top section 250*a* and the middle section 250*c*. Likewise, the second section 250*d* is between the middle section 250*c* and the bottom section 250*e*. The dimensional relationships of bottle 200 described below are for the bottle 200 in the uncollapsed state.

As shown in FIG. 14C, at the middle section 250*c*, the panel distance $D_{11}$ is at a minimum value and the sidewall distance $D_{12}$ is at a maximum value. As shown in FIG. 14A, at the top section 250*a*, the panel distance $D_{11}$ is at a maximum value relative to the middle section 250*c*, and the sidewall distance $D_{12}$ is at a minimum value relative to the middle section 250*c*. As shown in FIG. 14B, at the first section 250*b* between the top section 250*a* and the middle section 250*c*, the panel distance Du is less than the value of the top section 250*a* and greater than the value of the middle section 250*c*, and the sidewall distance $D_{12}$ is greater than the value of the top section 250*a* and less than the value of the middle section 250*c*.

Similar to the top section 250*a*, as shown in FIG. 14E, at the bottom section 250*e*, the panel distance $D_{11}$ is at a maximum value and the sidewall distance $D_{12}$ is at a minimum value relative to these dimensions at middle section 250*c*. Similar to the first section 250*b*, the panel distance Du is less than the value of the bottom section 250*e* and greater than the value of the middle section 250*c*, and the sidewall distance $D_{12}$ is greater than the value of the bottom section 250*e* and less than the value of the middle section 250*c*.

The contour of the collapsible portion 250 varies along longitudinal axis A, between the first end 260 and second ends 262. More specifically, the panel distance Du varies between the first and second ends 260, 262. The panel distance Du is narrowed as the collapsible portion 250 extends from the first end 260 longitudinally toward the middle of the collapsible portion, and the panel distance $D_{11}$ is expanded as the collapsible portion extends longitudinally from the middle of the collapsible portion toward the second end 262. Additionally, the sidewall distance $D_{12}$ varies between the first and second ends 260, 262. The sidewall distance $D_{12}$ is expanded as the collapsible portion 250 extends from the first end 260 longitudinally toward the middle of the collapsible portion, and the sidewall distance $D_{12}$ is narrowed as the collapsible portion extends longitudinally from the middle of the collapsible portion toward the second end 262.

The panel distance $D_{11}$ is in the range of 20 mm (0.79 in) to 80 mm (3.15 in) and the sidewall distance $D_{12}$ is in the range of 50 mm (1.97 in) to 165 mm (6.50 in).

At the top section 250*a*, the panel distance $D_{11}$ is preferably 59.1 mm (2.32 in) and the sidewall distance $D_{12}$ is preferably 26.08 mm (1.03 in). At the middle section 250*c*, the panel distance $D_{11}$ is preferably 67.17 mm (2.64 in) and the sidewall distance $D_{12}$ is preferably 29.21 mm (1.15 in). At the bottom section 250*e*, the panel distance Du is preferably 59.21 mm (2.33 in) and the sidewall distance $D_{12}$ is preferably 26.08 mm (1.03 in).

A ratio of the panel distance $D_{11}$ at the top section 250*a* to the panel distance $D_{11}$ at the middle section 250*c* is preferably 0.88, and in the range of 0.75 to 0.95, and wherein a ratio of the sidewall distance $D_{12}$ at the top section 250*a* to the sidewall distance $D_{12}$ at the middle section 250*c* is preferably 0.91, and in the range of 0.85 to 0.95.

A ratio of the panel distance $D_{11}$ at the bottom section 250*e* to the panel distance $D_{11}$ at the middle section 250*c* is preferably 0.88, and in the range of 0.85 to 0.95, and wherein a ratio of the sidewall distance $D_{12}$ at the bottom section 250*e* to the sidewall distance $D_{12}$ at the middle section 250*c* is preferably 0.91, and in the range of 0.85 to 0.95.

A ratio of the panel distance Du to the sidewall distance $D_{12}$ at the top section 150*a* is preferably 0.58, and in the range of 0.55 to 0.65

A ratio of the panel distance Du to the sidewall distance $D_{12}$ at the bottom section 150*e* is preferably 0.39, and in the range of 0.35 to 0.45

A ratio of the panel distance $D_{11}$ to the sidewall distance $D_{12}$ at the middle section 150*c* is preferably 0.58, and in the range of 0.55 to 0.65

As shown in FIGS. 14A through 14E, for each section (250*a*, 250*b*, 250*c*, 250*d*, 250*e*), the opposing panels 256, 258 have a panel radius $R_P$, and the opposing sidewalls 252, 254 have a sidewall radius $R_S$. At transitions between the opposing panels 256, 258 and the opposing sidewalls 252, 254, the continuous wall of the collapsible portion has a transition radius $R_T$ between the sidewall radius $R_S$ and the panel radius $R_P$.

As shown in FIG. 14C, at the middle section 250*c*, the panel radius $R_P$ is at a maximum value, the sidewall radius $R_S$ is at a minimum value and the transition radius $R_T$ is at a maximum value such that the transition radius forms substantially planar segment.

As shown in FIG. 14A, at the top section 250*a*, the panel radius $R_P$ is at a minimum value relative to the middle section 250*c*, the sidewall radius $R_S$ is at a maximum value relative to the middle section 250*c*, and the transition radius $R_T$ is at a minimum relative to the middle section 250*c*.

As shown in FIG. 14B, at the first section 250*b*, the panel radius $R_P$ is greater than the value of the top section 250*a* and less than the value of the middle section 250*c*, the sidewall radius $R_S$ is less than the value of the top section 250*a* and greater than the value of the middle section 250*c*, and the transition radius $R_T$ is greater than the value of the top section 250*a* and less than the value of the middle section 250*c*.

As shown in FIG. 14E, at the bottom section 250*e*, the panel radius $R_P$ is at a minimum value relative to the middle section 250*c*, the sidewall radius $R_S$ is at a maximum value relative to the middle section 250*c*, and the transition radius $R_T$ is at a minimum relative to the middle section 250*c*.

As shown in FIG. 14D, at the second section 250*d*, the panel radius $R_P$ is greater than the value of the bottom section 250*e* and less than the value of the middle section 250*c*, the sidewall radius $R_S$ is less than the value of the bottom section 250*e* and greater than the value of the middle section 250*c*, and the transition radius $R_T$ is greater than the value of the bottom section 250*e* and less than the value of the middle section 250*c*.

FIG. 15 illustrates a cross-sectional view of the bottle 200 oriented in an X-plane parallel to the exemplary X-plane of FIG. 10. In particular, FIG. 15 is a cross-section taken at the lateral middle of the collapsible portion 250. The lateral middle is defined by the plane equidistant from the opposing sidewalls 252, 254. The panel distance Du varies along the longitudinal axis A'. At the cross-section, the opposing panels 256, 258 have a middle radius R13 between the first end 260 and the second end 262. As shown in FIG. 15, the bottle 200 has an hourglass shape. With reference to FIG. 7 of the bottle 100, the hourglass shape of the bottle 200 is less pronounced than the hourglass shape of the bottle 100.

With reference to FIGS. 10 and 12, when the bottle 200 is squeezed by an infant or a consumer, and application of forces F to the opposing panels 256, 258 causes the opposing panels 256, 258 to collapse. As a result, the panel distance $D_{11}$ between the opposing panels 256, 258 of FIG. 12 decrease to a fully collapsed panel distance defining a collapsed state of the bottle 200. Furthermore, the curved contour shape of the opposing panels 256, 258 is flattened such that the opposing panels 256, 258 are substantially flat, and the longitudinal curvature 264 and the laterally extending curvature 266 are substantially flat.

Application of forces F to the opposing panels 256, 258 stores potential energy within the collapsible portion 250 such that the opposing panels 256, 258 (and the collapsible portion 250 generally)—rebound after non-application of force. When the forces F are no longer applied to the opposing panels 256, 258, the flattened compound curvature causes the opposing panels 256, 258 to "spring back" and elastically rebound, thereby returning the bottle to the uncollapsed state.

The spring-back effect of the opposing panels 256, 258 is achieved by elastic potential energy stored within the collapsible portion 250 due to application of the forces F to the opposing panels 256, 258. The stored elastic potential energy creates sufficient bounce-back to return the opposing panels 256, 258 to the normal upon releasing (non-application) of the applied forces F.

In particular, the opposing panels 256, 258 exhibit a flexural behavior having a single degree of freedom subject to uniaxial bending due to the compound curvature shape of the opposing panels 256, 258. This flexural behavior functions similar to a biasing element or spring which tends to elastically rebound after non application of forces. Thus, flattening of the collapsible portion 250 stores elastic potential energy in the opposing panels 256, 258, and the non-application of forces F releases the elastic potential energy, converting it to kinetic energy.

Figure 16:
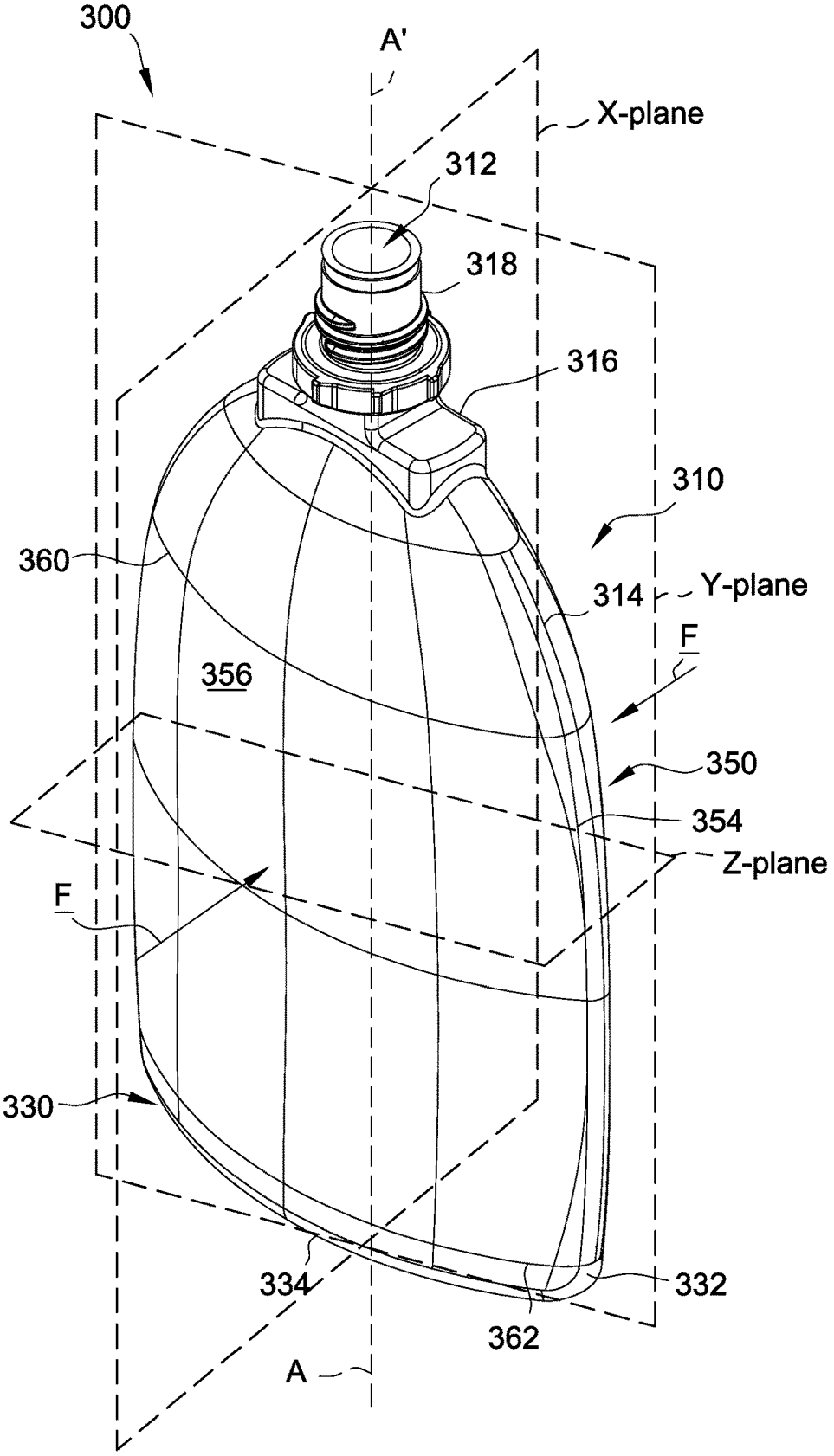
FIG. 16 illustrates a perspective view of an alternative embodiment of a collapsible blow-molded bottle having a flat base.

FIG. 16 illustrates a perspective view of an exemplary collapsible blow-molded bottle 300 (hereinafter referred to as "bottle 300") having a collapsible base in accordance with embodiments of the present disclosure. The bottle 300 includes a top portion 310, a collapsible bottom portion 330 and a collapsible portion 350 disposed between the top portion 310 and the collapsible bottom portion 330. The collapsible portion 350 includes a first end 360 and a second end 362 adjacent to and integral with the top portion 310 and bottom portion 330 respectively such that the top portion 310, the bottom portion 330 and the collapsible portion 350 define a unitary bottle body. Although the ends 360, 362 are shown as a seam/end in the figures, it should be understood that these are represented in this manner for purposes of describing the exemplary embodiment of bottle 300. In some embodiments, the bottle 300 is seamless as a result of the blow-molding process. The top portion, bottom portion, and collapsible portions 310, 330, 350 respectively define a hollow interior cavity of the bottle. Unless stated otherwise, the bottle walls have a uniform thickness which is preferably 0.017 in (0.43 mm).

Figure 17:
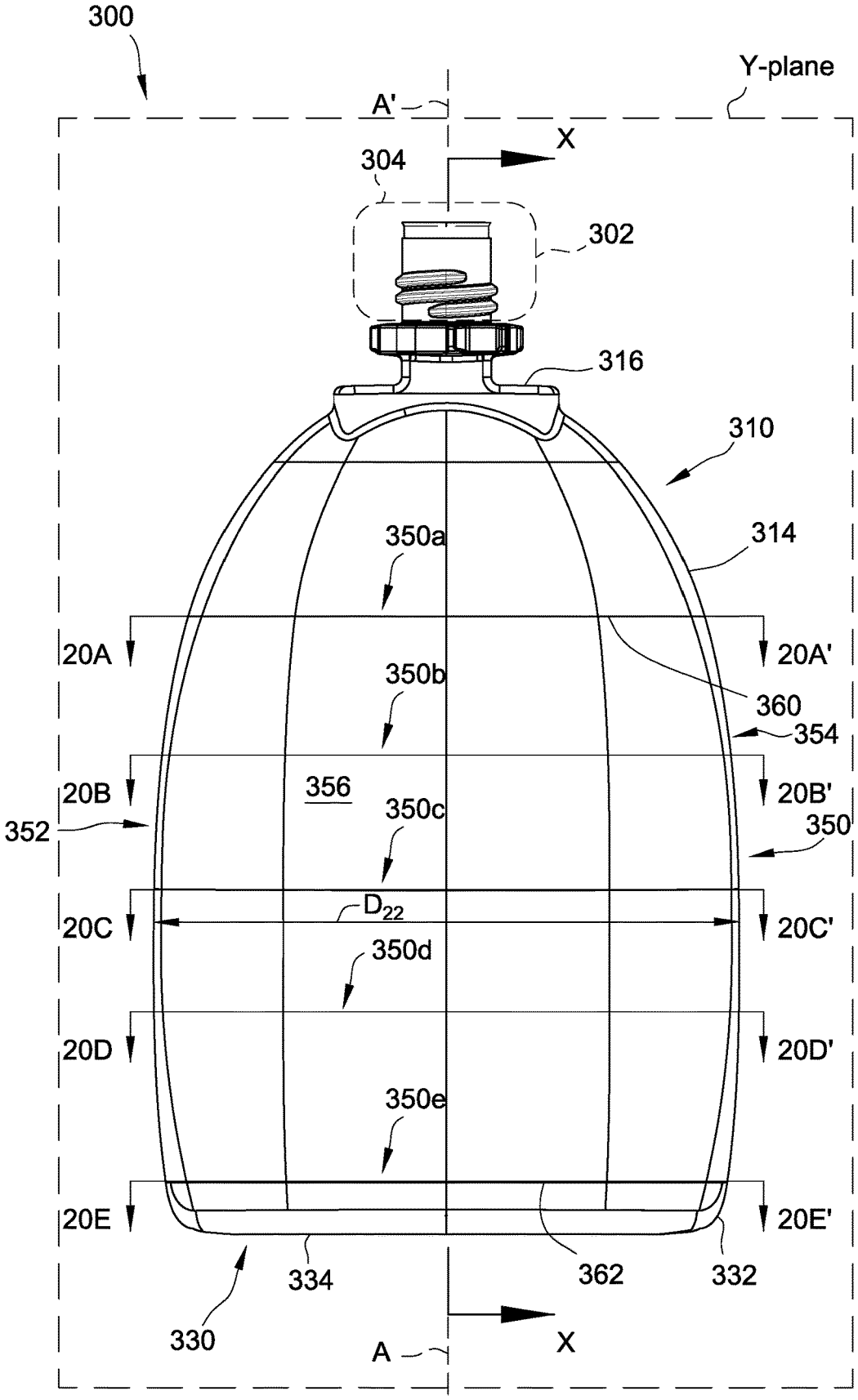
FIG. 17 illustrates a front view in a Y-plane of the collapsible blow-molded bottle of FIG. 16.
Figure 18:
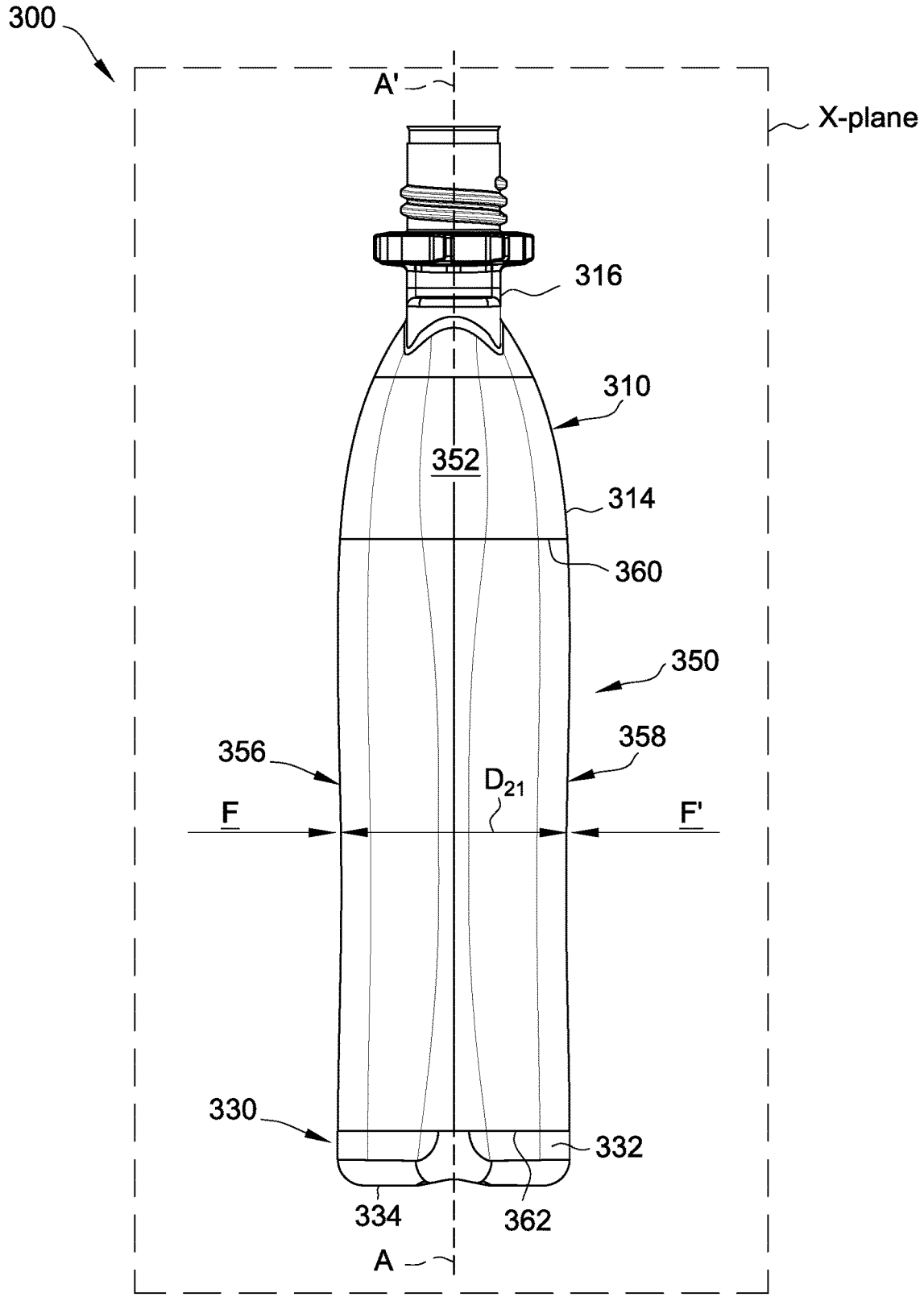
FIG. 18 illustrates a side view in an X-plane of the collapsible blow-molded bottle of FIG. 16.

FIG. 17 illustrates a front view of the bottle 300 oriented in the Y-plane and FIG. 18 illustrates a side view of the bottle 300 oriented in the X-plane. With reference to FIGS. 16 through 18, the top portion 310 comprises a rounded bottle shoulder section 314 adjacent to and integral with the collapsible portion 350, an upper shoulder 316 adjacent to and integral with the rounded bottle shoulder section 314, and a longitudinally extending spout 318 that terminates at an open end with an opening 312. The spout is made integral with the upper shoulder 316. In some embodiments, the spout 318 includes a threaded portion configured to threadedly connect to a cap 302 having a flat top surface 304.

With reference to FIGS. 16 through 19 and 21, the collapsible bottom portion 330 includes a rounded base section 332 and a flat base 334 adjacent to the rounded base section 332. The rounded section 332 includes a second boundary 338 located a distance from the flat base 334.

Figure 19:
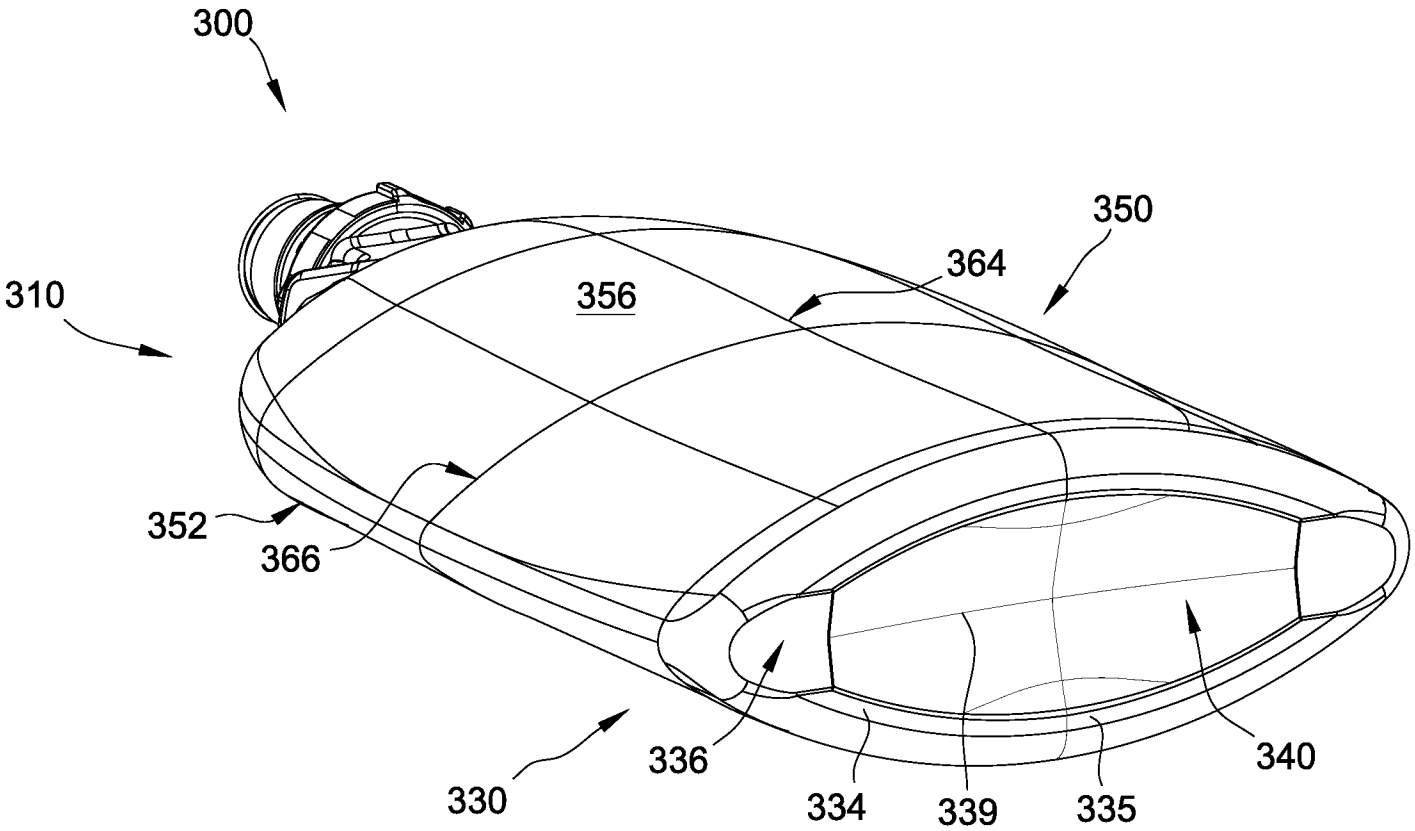
FIG. 19 illustrates a perspective view of the collapsible blow-molded bottle of FIG. 10, with emphasis of a compound curvature of the collapsible blow-molded bottle.
Figure 21:
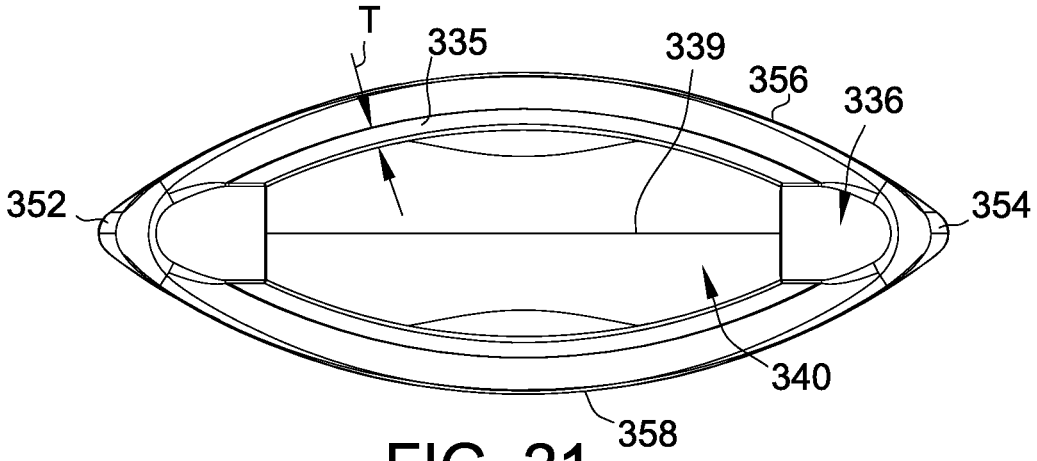
FIG. 21 illustrates a bottom view of the blow-molded bottle of FIG. 16; and, FIG. 22 illustrates a cross-sectional view of the collapsible blow-molded bottle of FIG. 10 across an X-plane that is parallel to the exemplary X-plane of FIG. 16.

As best shown in FIGS. 19 and 21, the rounded base section 332 transitions to the flat base 334. The flat base 334 has semi-oval protrusions 335 having a width T, separated by lateral creases 336. Inwardly of and adjacent to the flat base 334, the collapsible bottom portion 330 includes a concave domed surface 340. Stated differently, the semi-oval protrusions 335 are separated from the concave domed surface 340. The bottle 300 can be supported along the base and oriented vertically or upright where the flat base 334 rests on a surface. In some embodiments, the bottle 300 can be stored inverted (i.e. upside down) where the top surface 304 of the cap 302 rests on the supporting surface. Storing the bottle 300 inverted promotes movement of the contents of the bottle toward the opening 312 of the bottle 300.

With reference to FIGS. 16 through 19, the collapsible portion 350 includes opposing panels 356, 358 and opposing sidewalls 352, 354 forming a continuous wall of the collapsible portion 350. The opposing panels 356, 358 and opposing sidewalls 352, 354 extend longitudinally along axis A', and between the top portion 310 and the collapsible bottom portion 330. As shown in FIG. 18, the opposing panels 356, 358 are separated by a panel distance $D_{21}$ in the X-plane, and as shown in FIG. 17, the opposing sidewalls 352, 354 are separated by a distance $D_{22}$ in the Y-plane.

Figure 22:
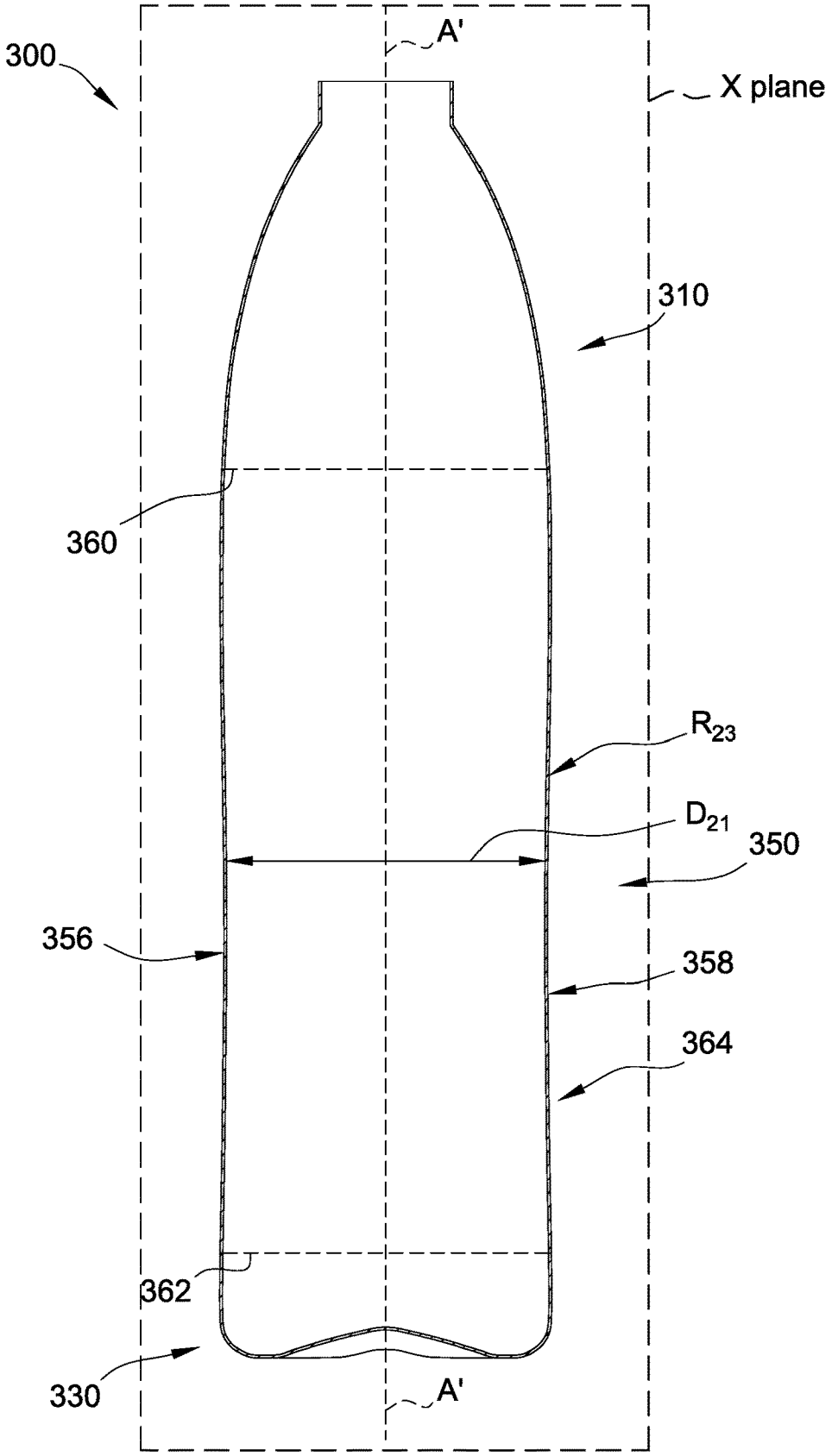

As best shown in FIG. 19, the opposing panels 356, 358 have a contoured shape defined by a compound curvature. The compound curvature is defined by a longitudinally extending curvature 364 extending along the opposing panels 356, 358 from the first end 360 to the second end 362, and by a laterally extending curvature 366 extending between the opposing sidewalls 352, 354. The longitudinally extending curvature 364 is concave and the laterally extending curvature 366 is convex. As a result, the opposing panels 356, 358 together form an hourglass shape oriented along the X-plane (as shown in FIGS. 18 and 22) and the opposing panels 356, 358 together form an ovalized shape in the Z-Plane (as shown in FIGS. 20A through 20E and 21).

As shown in FIG. 17, the bottle 300 is asymmetrical in the Y-Plane orientation, with the distance $D_{22}$ at a maximum in the collapsible portion 350, and specifically at a maximum at section 350*c*, which is equidistant from the first end 360 and second end 362. Due to the asymmetry, section 350*c* is not equidistant from the upper shoulder 316 and the flat base 334. The distance $D_{22}$ within the top portion 310 is less than the distance $D_{22}$ within the collapsible portion 350 and the collapsible bottom portion 330.

Figure 20A:
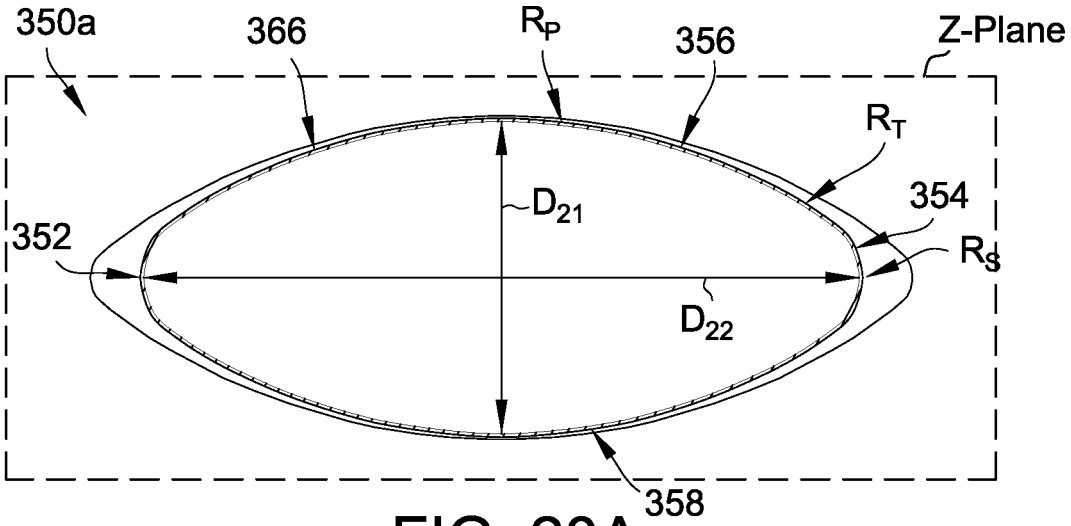
FIGS. 20A through 20E illustrate perspective cross-sectional views of the collapsible blow-molded bottle of FIG. 16 across a Z-plane parallel to the exemplary Z-plane of FIG. 16.
Figure 20B:
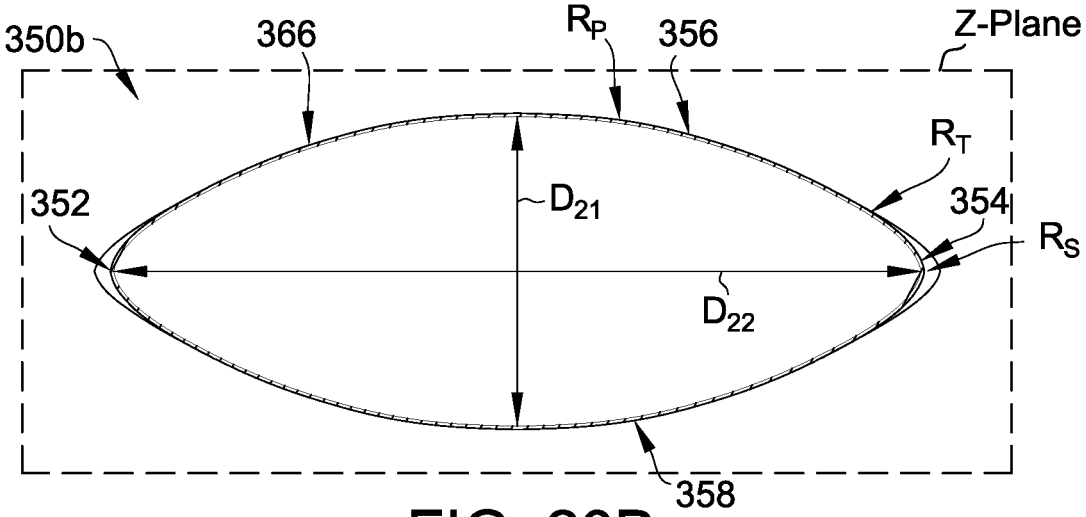
Figure 20C:
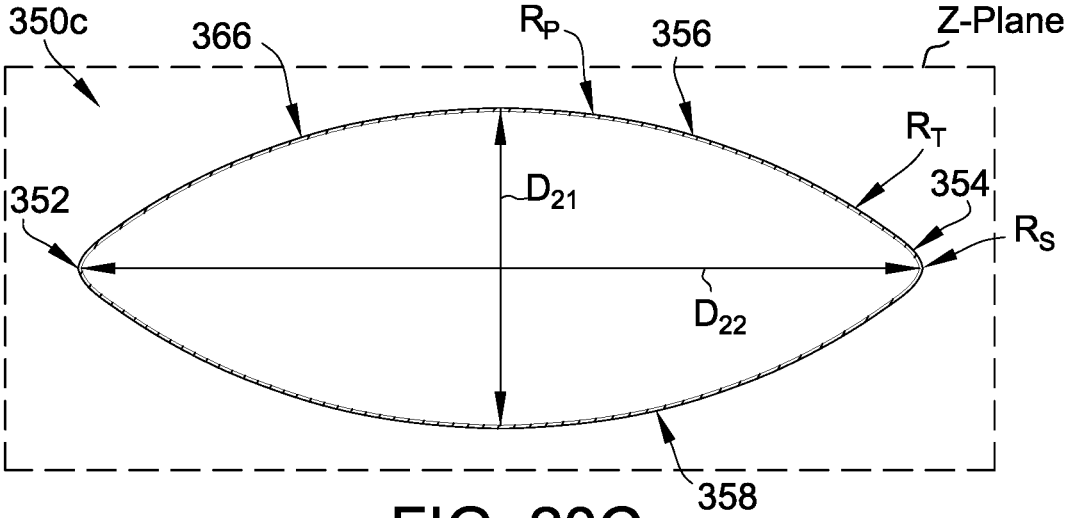
Figure 20D:
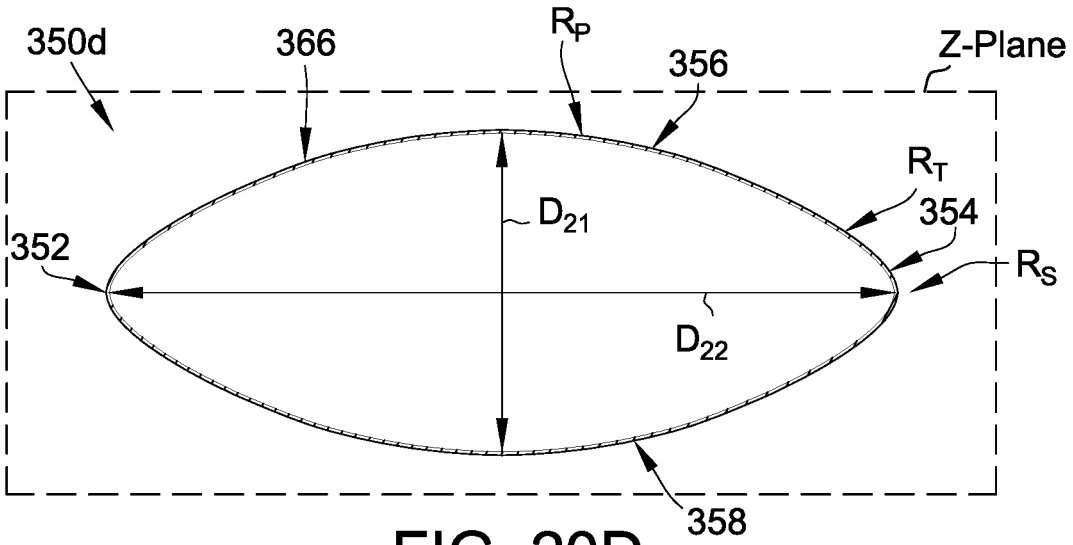
Figure 20E:
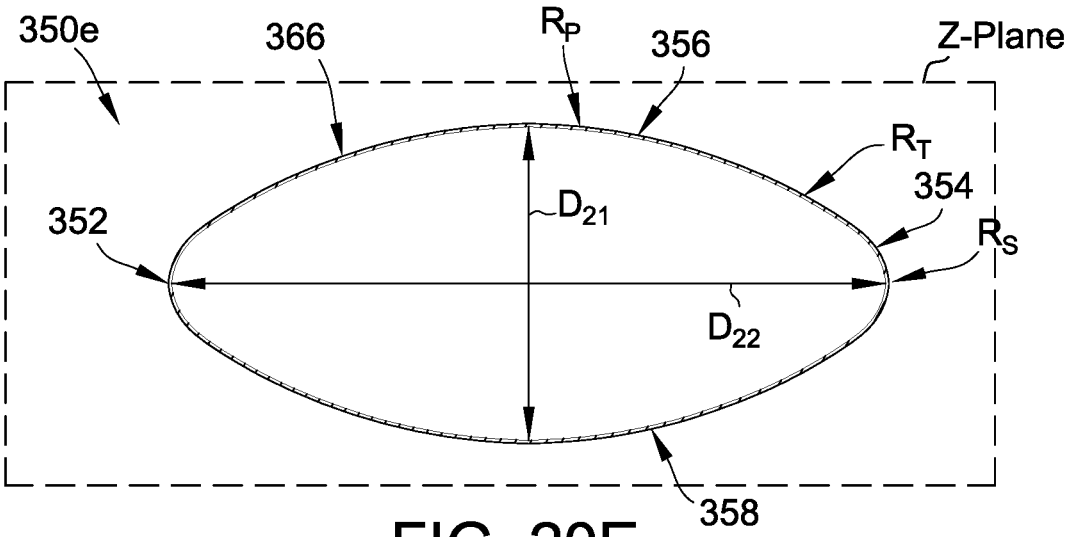

FIGS. 20A through 20E illustrate cross-sectional views of the collapsible portion 350 in the Z-plane. FIG. 20A illustrates a top section 350*a* of the collapsible portion 350 taken along line 20A-20A' of FIG. 17. FIG. 20B illustrates a first section 350*b* positioned a distance from the top section 350*a* taken along line 20B-20B' of FIG. 17. FIG. 20C illustrates a middle section 350*c* of the collapsible portion 350 taken along line 20C-20C' of FIG. 17. FIG. 20D illustrates a second section 350*d* positioned a distance from the middle section 350*c* taken along line 20D-20D' of FIG. 17. FIG. 20E illustrates a bottom section 350*e* of the collapsible portion 350 taken along line 20E-20E' of FIG. 17. The first section 350*b* is between the top section 350*a* and the middle section 350*c*. Likewise, the second section 350*d* is between the middle section 350*c* and the bottom section 350*e*. The dimensional relationships of bottle 300 described below are for the bottle 300 in the uncollapsed state.

As shown in FIG. 20C, at the middle section 350*c*, the panel distance $D_{21}$ is at a minimum value and the sidewall distance $D_{22}$ is at a maximum value. As shown in FIG. 20A, at the top section 350*a*, the panel distance $D_{21}$ is at a maximum value relative to the middle section 350*c*, and the sidewall distance $D_{22}$ is at a minimum value relative to the middle section 350*c*. As shown in FIG. 20B, at the first section 350*b* between the top section 350*a* and the middle section 350*c*, the panel distance $D_{21}$ is less than the value of the top section 350*a* and greater than the value of the middle section 350*c*, and the sidewall distance $D_{22}$ is greater than the value of the top section 350*a* and less than the value of the middle section 350*c*.

Similar to the top section 350A, as shown in FIG. 20E, at the bottom section 350*e*, the panel distance $D_{21}$ is at a maximum value and the sidewall distance $D_{22}$ is at a minimum value relative to the middle section 350*c*. Similar to the first section 350*b*, the panel distance $D_{21}$ is less than the value of the bottom section 350*e* and greater than the value of the middle section 350*c*, and the sidewall distance $D_{22}$ is greater than the value of the bottom section 350*e* and less than the value of the middle section 350*c*.

The contour of the collapsible portion 350 varies along longitudinal axis A, between the first end 360 and second ends 362. More specifically, the panel distance $D_{21}$ varies between the first and second ends 360, 362. The panel distance $D_{21}$ is narrowed as the collapsible portion extends from the first end longitudinally toward the middle of the collapsible portion, and the panel distance $D_{21}$ is expanded as the collapsible portion extends longitudinally from the middle of the collapsible portion toward the second end 362. Additionally, the sidewall distance $D_{22}$ varies between the first and second ends 360, 362. The sidewall distance $D_{22}$ is expanded as the collapsible portion extends from the first end 360 longitudinally toward the middle of the collapsible portion, and the sidewall distance $D_{22}$ is narrowed as the collapsible portion extends longitudinally from the middle of the collapsible portion toward the second end 362.

Due to the asymmetry of the bottle 300 in the Y-Plane, the distance $D_{22}$ at line 350*b* is less than the distance $D_{22}$ at line 350*d* (as shown in FIGS. 17, 20B and 20D). Likewise, the distance $D_{22}$ at line 350*a* is less than the distance $D_{22}$ at line 350*e*, corresponding to the first end 360 and second end 362 (as shown in FIGS. 17, 20A and 20E). As shown in FIGS. 18 and 22, the collapsible portion 350 is symmetrical, but the bottle 300 (the top portion 310, collapsible bottom portion 330 and collapsible portion 350) is asymmetrical.

The panel distance $D_{21}$ is in the range of 20 mm (0.79 in) to 80 mm (3.15 in) and the sidewall distance $D_{22}$ is in the range of 50 mm (1.97 in) to 165 mm (6.50 in).

At the top section 350*a*, the panel distance $D_{21}$ is preferably 61.96 mm (2.44 in) and the sidewall distance $D_{22}$ is preferably 26.08 mm (1.03 in). At the middle section 350*c*, the panel distance $D_{21}$ is preferably 70.29 mm (2.77 in) and the sidewall distance $D_{22}$ is preferably 25.78 mm (1.01 in). At the bottom section 350*e*, the panel distance $D_{21}$ is preferably 67.37 mm (2.65 in) and the sidewall distance $D_{22}$ is preferably 26.61 mm (1.05 in).

A ratio of the panel distance $D_{21}$ at the top section 350*a* to the panel distance $D_{21}$ at the middle section 350*c* is preferably 0.88, and in the range of 0.75 to 0.95, and wherein a ratio of the sidewall distance $D_{22}$ at the top section 350*a* to the sidewall distance $D_{22}$ at the middle section 350*c* is preferably 0.91, and in the range of 0.85 to 0.95.

A ratio of the panel distance $D_{21}$ at the bottom section 350*e* to the panel distance $D_{21}$ at the middle section 350*c* is preferably 0.88, and in the range of 0.85 to 0.95, and wherein a ratio of the sidewall distance $D_{22}$ at the bottom section 350*e* to the sidewall distance $D_{22}$ at the middle section 350*c* is preferably 0.91, and in the range of 0.85 to 0.95.

A ratio of the panel distance $D_{21}$ to the sidewall distance $D_{22}$ at the top section 150*a* is preferably 0.58, and in the range of 0.55 to 0.65.

A ratio of the panel distance $D_{21}$ to the sidewall distance $D_{22}$ at the bottom section 150*e* is preferably 0.39, and in the range of 0.35 to 0.45.

A ratio of the panel distance $D_{21}$ to the sidewall distance $D_{22}$ at the middle section 150*c* is preferably 0.58, and in the range of 0.55 to 0.65.

As shown in FIGS. 20A through 20E, for each section (350*a*, 350*b*, 350*c*, 350*d*, 350*e*), the opposing panels 356, 358 have a panel radius $R_P$, and the opposing sidewalls 352, 354 have a sidewall radius $R_S$. At transitions between the opposing panels 356, 358 and the opposing sidewalls 352, 354, the continuous wall of the collapsible portion has a transition radius $R_T$ between the sidewall radius $R_S$ and the panel radius $R_P$.

As shown in FIG. 20C, at the middle section 350*c*, the panel radius $R_P$ is at a maximum value, the sidewall radius $R_S$ is at a minimum value and the transition radius $R_T$ is at a maximum value such that the transition radius forms a substantially planar segment.

As shown in FIG. 20A, at the top section 350*a*, the panel radius $R_P$ is at a minimum value relative to the middle section 350*c*, the sidewall radius $R_S$ is at a maximum value relative to the middle section 350*c*, and the transition radius $R_T$ is at a minimum relative to the middle section 350*c*.

As shown in FIG. 20B, at the first section 350*b*, the panel radius $R_P$ is greater than the value of $R_P$ at the top section 350*a* and less than the value of $R_P$ at the middle section 350*c*, the sidewall radius $R_S$ is less than the value of the top section 350*a* and greater than the value of the middle section 350*c*, and the transition radius $R_T$ is greater than the value of the top section 350*a* and less than the value of the middle section 350*c*.

As shown in FIG. 20E, at the bottom section 350*e*, the panel radius $R_P$ is at a minimum value relative to the middle section 350*c*, the sidewall radius $R_S$ is at a maximum value relative to the middle section 350*c*, and the transition radius $R_T$ is at a minimum relative to the middle section 350*c*.

As shown in FIG. 20D, at the second section 350*d*, the panel radius $R_P$ is greater than the value of the bottom section 350*e* and less than the value of the middle section 350*c*, the sidewall radius $R_S$ is less than the value of the bottom section 350*e* and greater than the value of the middle section 350*c*, and the transition radius $R_T$ is greater than the value of the bottom section 350*e* and less than the value of the middle section 350*c*.

FIG. 22 illustrates a cross-sectional view of the bottle 300 across an X-plane that is parallel to the exemplary X-plane of FIG. 18. In particular, FIG. 22 is a cross-section taken at the lateral middle of the collapsible portion 350. The lateral middle is defined by the plane equidistant from the opposing sidewalls 352, 354. The panel distance $D_{21}$ varies at any point along the longitudinal axis A'. At the cross-section, the opposing panels 356, 358 have a middle radius R23 between the top first end 360 and the second end 362. As shown in FIG. 22, the bottle 300 has an hourglass shape. With reference to FIG. 7 of the bottle 100, the hourglass shape of the bottle 300 is less pronounced than the hourglass shape of the bottle 100.

With reference to FIGS. 16 and 18, when the bottle 300 is squeezed by an infant or a consumer, and application of forces F to the opposing panels 356, 358 causes the opposing panels 356, 358 to collapse. As a result, the panel distance $D_{21}$ between the opposing panels 356, 358 of FIG. 18 decrease to a fully collapsed panel distance defining a collapsed state of the bottle 300, similar to the collapsed bottle 100 shown in FIG. 8. Furthermore, the curved contour shape of the opposing panels 356, 358 is flattened such that the opposing panels 356, 358 are substantially flat, and the longitudinal curvature 364 and the laterally extending curvature 366 are substantially flat.

Application of forces F to the opposing panels 356, 358 stores potential energy within the collapsible portion 350 such that the opposing panels 356, 358 (and the collapsible portion 350 generally)—rebound after non-application of force. When the forces F are no longer applied to the opposing panels 356, 358, the flattened compound curvature causes the opposing panels 356, 358 to "spring back" and elastically rebound, thereby returning the bottle to the uncollapsed state.

The spring-back effect of the opposing panels 356, 358 is achieved by elastic potential energy stored within the collapsible portion 350 due to application of the forces F to the opposing panels 356, 358. The stored elastic potential energy creates sufficient bounce-back to return the opposing panels 356, 358 to the normal upon releasing (non-application) of the applied forces F.

In particular, the opposing panels 356, 358 exhibit a flexural behavior having a single degree of freedom subject to uniaxial bending due to the compound curvature shape of the opposing panels 356, 358. This flexural behavior functions similar to a biasing element or spring which tends to elastically rebound after non application of forces. Thus, flattening of the collapsible portion 350 stores elastic potential energy in the opposing panels 356, 358, and the non-application of forces F releases the elastic potential energy, converting it to kinetic energy.

Similar to the collapsible portion 350, application of the force F collapses the collapsible bottom portion 330. Referring to FIGS. 19 and 21, the collapsible bottom portion 330 folds at a midline 339, urging the concave domed surface 340 inward. Due to potential energy stored in the concave domed surface 340, the collapsible bottom portion 330 springs back upon non-application of the forces F. The spring-back effect of the concave domed surface 340 is due in part to the concave domed surface 340 exhibiting flexural behavior having a single degree of freedom subject to uniaxial bending, with the semi-oval protrusions 335 limiting outward deflection of the concave domed surface 340. As the concave domed surface 340 folds and flattens due to the application of the force F, potential energy is stored, and is subsequently released upon non-application of the force F. The lateral creases 336 allow for the concave domed surface 340 to fold.

From the bottles 100, 200, 300 described herein, the compound curvatures of the collapsible portions 150, 250, 350 and dimension relationships enable the reboundability and collapsibility of the bottles 100, 200, 300.

Other variations to the disclosed embodiments can be understood and effected by those skilled in the art in practicing the claimed invention, from the study of the drawings, the disclosure, and the appended claims. In the claims the word "comprising" does not exclude other elements or steps and the indefinite article "a" or "an" does not exclude a plurality. The mere fact that certain measures are recited in mutually different dependent claims does not indicate that a combination of these measures cannot be used to advantage. Any reference signs in the claims should not be construed as limiting the scope of the claims.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A blow-molded bottle comprising:

a top portion;

a bottom portion; and, a collapsible portion disposed between the top portion and the bottom portion; the top portion, bottom portion and collapsible portion define a unitary bottle body; the collapsible portion, in an uncollapsed state, further comprising:

opposing panels and opposing sidewalls forming a continuous wall of the collapsible portion, wherein each of the opposing panels having a contoured shape defined by a compound curvature and each of the sidewalls having a convex shape;

wherein the opposing panels comprise a first end and a second end, and wherein a middle section of the collapsible portion is between the first end and the second end, and wherein at the middle section of the collapsible portion a distance between the panels is at a minimum value and a distance between the sidewalls is at a maximum value.

2. The bottle of claim 1, wherein the compound curvature is defined by a longitudinally extending curvature extending from the first end to the second end of the opposing panels, the first end adjacent to the top portion and the second end adjacent to the bottom portion, and a laterally extending curvature extending between the opposing sidewalls.

3. The bottle of claim 2, wherein the laterally extending curvature is convex, and the longitudinally extending curvature is concave.

4. The bottle of claim 3, wherein a top section of the collapsible portion is at the first end, and a bottom section is at the second end.

5. The bottle of claim 4, wherein each of the opposing panels have a panel radius, each of the sidewalls have a sidewall radius, and wherein the collapsible portion has a transition radius between the panel radius and the sidewall radius.

6. The bottle of claim 5, wherein a value of the panel radius varies along the collapsible portion between the first end and the second end, wherein a value of the sidewall radius varies along the collapsible portion between the first end and the second end, and wherein a value of the transition radius varies along the collapsible portion between the first end and the second end.

7. The bottle of claim 6, wherein at the middle section of the collapsible portion the panel radius is at a maximum value, the sidewall radius is at a minimum value and the transition radius is at a maximum value such that the transition radius forms a straight line.

8. The bottle of claim 6, wherein at the top section of the collapsible portion the panel radius is at a minimum value, the sidewall radius is at a maximum value, and the transition radius is at a minimum.

9. The bottle of claim 6, wherein at the bottom section of the collapsible portion the panel radius is at a minimum value, the sidewall radius is at a maximum value, and the transition radius is at a minimum.

10. The bottle of claim 6, wherein the top section and the middle section are symmetrical, and wherein at the top section and bottom section, the panel radius is at a minimum value, the sidewall radius is at a maximum value, and the transition radius is at a minimum.

11. The bottle of claim 1, wherein the middle section of the collapsible portion is equidistant between the first end and the second end.

12. The bottle of claim 1, wherein the distance between the panels varies along the collapsible portion between the first end and the second end, and wherein the distance between the sidewalls varies along the collapsible portion between the first end and the second end.

13. The bottle of claim 12, wherein at the top section of the collapsible portion the distance between the panels is at a maximum value and the distance between the sidewalls is at a minimum value.

14. The bottle of claim 12, wherein at the bottom section of the collapsible portion the distance between the panels is at a maximum value and the distance between the sidewalls is at a minimum value.

15. The bottle of claim 12, wherein the top section and the middle section are symmetrical, and wherein at the top section and bottom section, the distance between the panels is at a maximum value and the distance between the sidewalls is at a minimum value.

16. The bottle of claim 12, wherein a ratio of the value of the distance between the panels at the top section of the collapsible portion to the value of the distance between the panels at the middle section of the collapsible portion is in the range of 0.75 to 0.95, and wherein a ratio of the value of the distance between the sidewalls at the top section of the collapsible portion to the value of the distance between the sidewalls at the middle section of the collapsible portion is in the range of 0.85 to 0.95.

17. The bottle of claim 12, wherein a ratio of the value of the distance between the panels at the bottom section of the collapsible portion to the value of the distance between the panels at the middle section of the collapsible portion is in the range of 0.85 to 0.95, and wherein a ratio of the value of the distance between the sidewalls at the bottom section of the collapsible portion to the value of the distance between the sidewalls at the middle section of the collapsible portion is in the range of 0.85 to 0.95.

18. The bottle of claim 12, wherein a ratio of the distance between the panels value to the distance between the sidewalls value at the top section of the collapsible portion is in the range of 0.55 to 0.65.

19. The bottle of claim 12, wherein a ratio of the distance between the panels value to the distance between the sidewalls value at the bottom section of the collapsible portion is in the range of 0.35 to 0.45.

20. The bottle of claim 12, wherein a ratio of the distance between the panels value to the distance between the sidewalls value at the middle section of the collapsible portion is in the range of 0.55 to 0.65.

21. The bottle of claim 2, wherein application of a force to the opposing panels causes the opposing panels to collapse from an uncollapsed state to a collapsed state.

22. The bottle of claim 21, wherein non-application of the force to the opposing panels returns the opposing panels to the uncollapsed state.

23. The bottle of claim 2, wherein the bottom portion is collapsible and reboundable.

24. The bottle of claim 23, wherein the bottom portion has an ovalized base section having a dome shape.

25. The bottle of claim 2, wherein the bottom portion includes a flat base and a convexly rounded section between the flat base and the collapsible portion.

26. The bottle of claim 25, wherein the flat base has semi-oval protrusions having a width, the protrusions separated by lateral creases.

27. The bottle of claim 26, wherein the semi-oval protrusions are separated by a concave domed surface.

28. The bottle of claim 27, wherein application of force collapses and folds the concave domed surface at a midline of the concave domed surface.

29. The bottle of claim 28, wherein the bottom portion springs back upon non- application of the force.

30. The bottle of claim 2, wherein the bottle has an ovalized shape along a plane transverse to a longitudinal axis of the bottle.

31. A blow-molded bottle comprising:

a top portion;

a bottom portion; and, a collapsible portion disposed between the top portion and the bottom portion; the top portion, bottom portion and collapsible portion define a unitary bottle body; the collapsible portion further comprising:

opposing panels and opposing sidewalls forming a continuous wall of the collapsible portion, the opposing panels being separated by a panel distance, and the sidewalls being separated by a sidewall distance; wherein each of the opposing panels having a contoured shape defined by a compound curvature and the sidewalls having a convex shape;

wherein the opposing panels collapse when a force is applied to the opposing panels and the opposing panels elastically rebound upon non-application of the force.

32. The bottle of claim 31, wherein each of the opposing panels have a contoured shape defined by a compound curvature.

33. The bottle of claim 32, wherein the compound curvature is defined by a longitudinally extending curvature extending from a first end to a second end of the opposing panels and a laterally extending curvature extending between the opposing sidewalls.

34. The bottle of claim 33, wherein the laterally extending curvature is convex, and the longitudinally extending curvature is concave.

35. The bottle of claim 34, wherein application of the force to the opposing panels flattens the longitudinally extending curvature and the laterally extending curve such that the compound curvature stores potential energy configured to rebound the opposing panels to an uncollapsed state after non-application of force.

36. The bottle of claim 34, wherein a middle section of the collapsible portion is between the first end and second end, and wherein at the middle section of the collapsible portion a distance between the panels is at a minimum value and a distance between the sidewalls is at a maximum value.

* * * * *